US011965290B2

(12) United States Patent
Anderson

(10) Patent No.: US 11,965,290 B2
(45) Date of Patent: Apr. 23, 2024

(54) APPARATUS AND METHOD FOR PROCESSING WOOD FIBERS

(71) Applicant: INTERNATIONAL PAPER COMPANY, Memphis, TN (US)

(72) Inventor: Dwight Edward Anderson, Cincinnati, OH (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 17/315,638

(22) Filed: May 10, 2021

(65) Prior Publication Data

US 2021/0262166 A1 Aug. 26, 2021

Related U.S. Application Data

(63) Continuation of application No. 15/860,055, filed on Jan. 2, 2018, now Pat. No. 11,001,968.

(51) Int. Cl.
*D21D 1/30* (2006.01)
*D21D 1/00* (2006.01)

(52) U.S. Cl.
CPC ..... *D21D 1/303* (2013.01); *D21D 1/008* (2013.01); *D21D 1/30* (2013.01); *D21D 1/306* (2013.01)

(58) Field of Classification Search
None
See application file for complete search history.

(56) References Cited

U.S. PATENT DOCUMENTS 3,149,792 A 9/1964 Textor
3,327,952 A * 6/1967 Rosenfeld ..... D21D 1/006 241/15

(Continued)

FOREIGN PATENT DOCUMENTS

AU 760157 5/2003
CA 2483444 A1 7/2010

(Continued)

OTHER PUBLICATIONS

Aito Alahautala et al.: "Optical measurement of pulp quantity in a rotating disc refiner", Measurement Science and Technology Publication, Institute of Physics Publishing, Oct. 8, 2004, pp. 2256-2262, United Kingdom.

(Continued)

*Primary Examiner* — Dennis R Cordray
(74) *Attorney, Agent, or Firm* — Thomas W. Barnes, III

(57) ABSTRACT

A refining member comprising a refining body with a refining surface comprising first and second refiner bars separated by first and second refiner grooves, respectively. The first refiner bars extend from a radially inward position to a first radially outward position. The second refiner bars extend to a second radially outward position that is nearer to an outermost part of the refining body than the first radially outward position. The second refiner bars have a longitudinal length from about 0.6 cm to about 10 cm. The first and second refiner bars have a respective first and second maximum height extending upward from a floor of a respective, adjacent first or second refiner groove. The second maximum height is at least 0.35 mm less than the first maximum height. The first refiner bars are adapted to refine wood fibers and the second refiner bars are adapted to break up fiber bundles.

9 Claims, 12 Drawing Sheets

(56) References Cited

U.S. PATENT DOCUMENTS

| | | | | |
|---|---|---|---|---|
| 3,815,834 | A | 6/1974 | Gilbert | |
| 4,023,737 | A | 5/1977 | Leider et al. | |
| 4,692,211 | A * | 9/1987 | Roberts | D21H 11/18 162/149 |
| 5,046,672 | A | 9/1991 | Demler | |
| 5,200,038 | A | 4/1993 | Brown | |
| 5,425,508 | A | 6/1995 | Chaney | |
| 5,467,931 | A | 11/1995 | Dodd | |
| 5,695,136 | A | 12/1997 | Rohden | |
| 5,975,438 | A | 11/1999 | Garasimowicz | |
| 6,032,888 | A | 3/2000 | Deuchars | |
| 6,311,907 | B1 | 11/2001 | Gringras | |
| 6,325,308 | B1 | 12/2001 | Lofgren et al. | |
| 6,402,071 | B1 | 6/2002 | Gingras | |
| 6,592,062 | B1 | 7/2003 | Virving | |
| 6,607,153 | B1 | 8/2003 | Gringras | |
| 7,458,533 | B2 | 12/2008 | Gringras | |
| 7,614,129 | B2 | 11/2009 | Matthew | |
| 7,758,726 | B2 | 7/2010 | Sabourin et al. | |
| 7,883,037 | B2 | 2/2011 | Gringras | |
| 8,028,945 | B2 | 10/2011 | Gringras | |
| 8,028,946 | B2 | 10/2011 | Vuorio | |
| 8,157,195 | B2 | 4/2012 | Gingras | |
| 8,342,437 | B2 | 1/2013 | Antensteiner | |
| 8,573,521 | B2 | 11/2013 | Gingras | |
| 8,573,522 | B2 | 11/2013 | Lindroos et al. | |
| 9,604,221 | B2 | 3/2017 | Gringras | |
| 10,767,309 | B2 | 9/2020 | Lindblom | |
| 10,927,499 | B2 | 2/2021 | Lindblom | |
| 11,001,968 | B2 | 5/2021 | Anderson | |
| 11,421,382 | B2 | 8/2022 | Anderson | |
| 2005/0161542 | A1 | 7/2005 | Theut | |
| 2006/0037728 | A1 | 2/2006 | Tempesta et al. | |
| 2007/0164143 | A1 | 7/2007 | Sabourin | |
| 2007/0210197 | A1 | 9/2007 | Carpenter | |
| 2008/0191078 | A1 | 8/2008 | Gingras | |
| 2009/0178774 | A1 * | 7/2009 | Brambilla | D21B 1/32 162/263 |
| 2014/0110511 | A1 | 4/2014 | Antensteiner | |
| 2014/0196858 | A1 | 7/2014 | Gingras | |
| 2016/0145798 | A1 | 5/2016 | Sjöström | |
| 2017/0073893 | A1 | 3/2017 | Bilodeau et al. | |
| 2017/0362773 | A1 | 12/2017 | Lindblom | |
| 2019/0078259 | A1 | 3/2019 | Anderson et al. | |
| 2021/0017705 | A1 | 1/2021 | Anderson | |
| 2022/0145537 | A1 | 5/2022 | Vuorio et al. | |
| 2023/0228034 | A1 | 7/2023 | Anderson | |

FOREIGN PATENT DOCUMENTS

| | | | |
|---|---|---|---|
| CN | 1491133 | A | 8/2006 |
| CN | 101619546 | B | 1/2010 |
| DE | 4210207 | C1 | 9/1993 |
| DE | 202014010374 | U1 | 6/2015 |
| EP | 1112123 | B1 | 2/2002 |
| EP | 2243879 | A2 | 10/2010 |
| EP | 1806450 | A1 | 5/2012 |
| EP | 2960367 | A1 | 12/2015 |
| JP | HEI04501145 | | 4/1992 |
| JP | HEI10502017 | | 2/1998 |
| JP | 2006022466 | A | 1/2006 |
| JP | 2007182660 | A | 7/2007 |
| JP | 2014015704 | A | 1/2014 |
| JP | 2014118668 | A | 6/2014 |
| RU | 2607753 | C2 | 1/2017 |
| RU | 2636165 | C2 | 11/2017 |
| RU | 2643423 | C2 | 2/2018 |
| WO | WO-199600615 | | 1/1996 |
| WO | WO-1999054046 | W | 10/1999 |
| WO | WO-2000009288 | A1 | 2/2000 |
| WO | WO-2001094020 | A1 | 12/2001 |
| WO | WO-2004078355 | A1 | 9/2004 |
| WO | WO-2020263296 | | 12/2020 |

OTHER PUBLICATIONS

Anders Karlström et al., "Plate Gap estimation based on Physical Refining Measurements", Chalmers Indstriteknik Foundation, Holmen Paper AB, Sweden.

Tom Lundin et al., "Fiber trapping in low-consistency refining: new parameters to describe the refining process", Low-consistency refining, Tappi Journal, Jul. 2008, pp. 15-21, Peachtree Corners, Georgia.

Liang, Qian Hua; Yan, Shi (2013). A Replaceable Refiner Plate and Method of Manufacture. Advanced Materials Research vols. 706-708 (2013) pp. 1189-1192. doi:10.4028/www.scientific.net/AMR.706-708.1189.

Observations:—Priorities were pointed out by documents from the WO2019136046 family, and can be found at: http://ccd.fiveipoffices.org/CCD-2.2.0/html/viewCcd.html?num=WO2019US12024&format=epodoc&type=application.

* cited by examiner

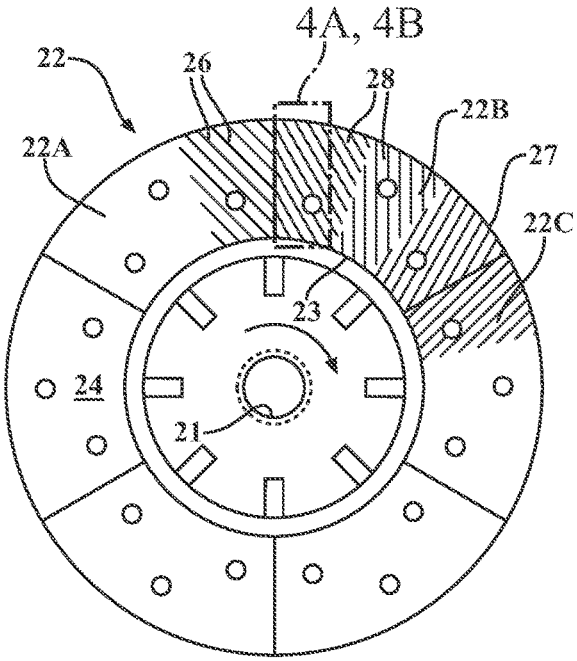
FIG. 2
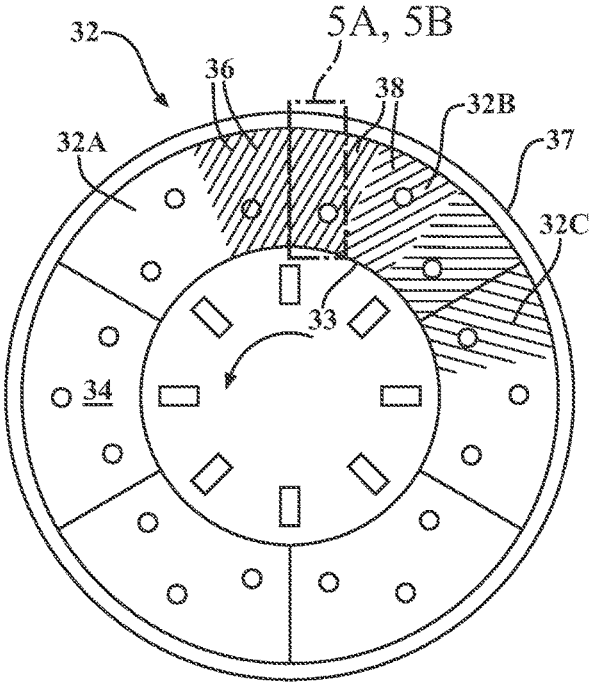
FIG. 3
FIG. 4A
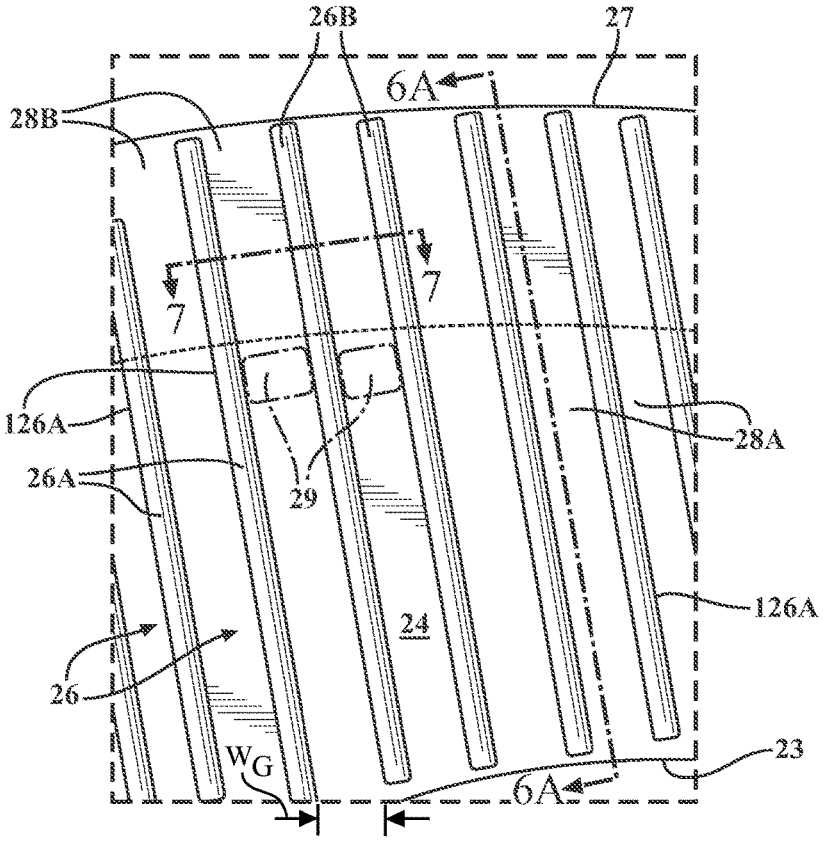

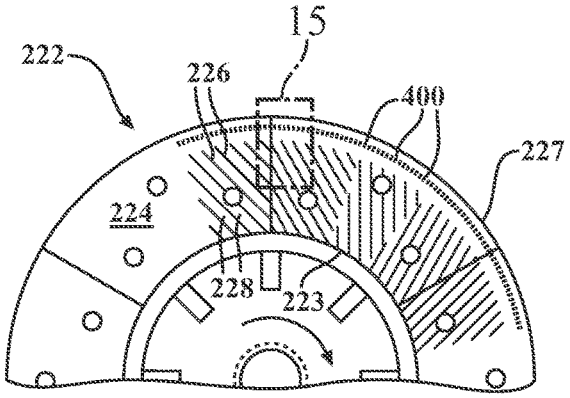
FIG. 13
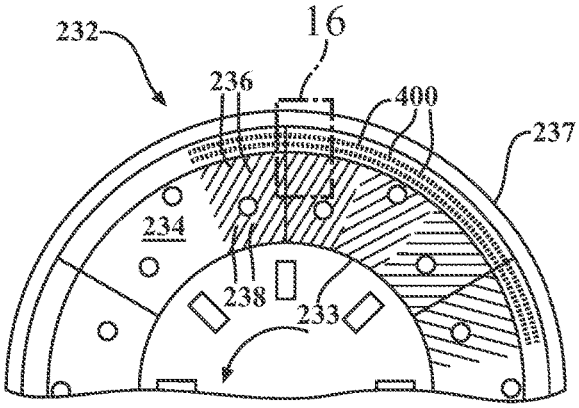
FIG. 14
FIG. 15
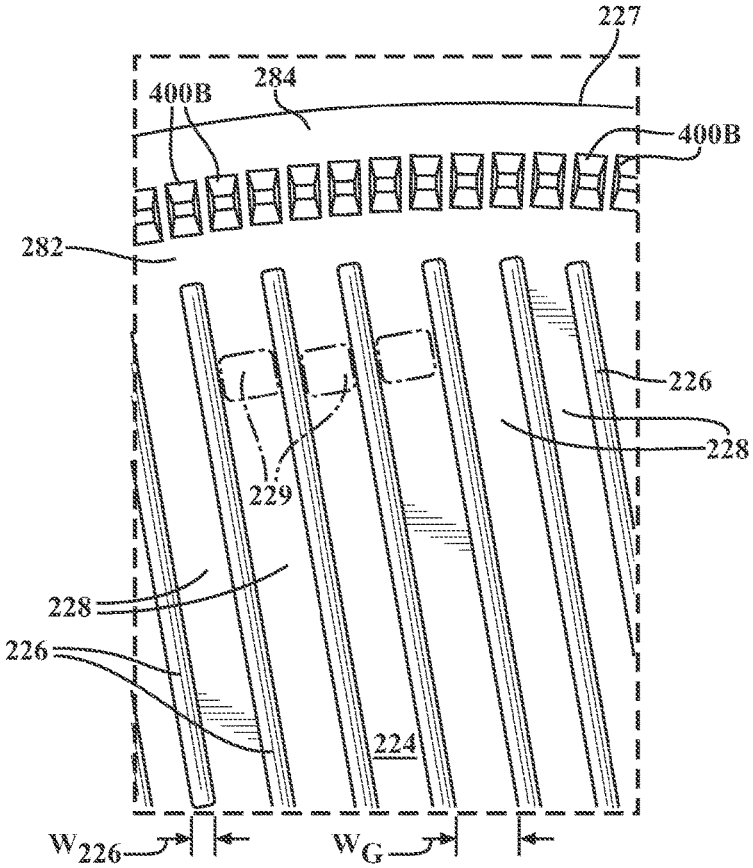

APPARATUS AND METHOD FOR PROCESSING WOOD FIBERS

RELATED APPLICATIONS

This application is a continuation of U.S. patent application Ser. No. 15/860,006 entitled "APPARATUS AND METHOD FOR PROCESSING WOOD FIBERS," which was filed on Jan. 2, 2018; and, which is herein incorporated by the reference in its entirety.

FIELD OF THE INVENTION

The present disclosure relates generally to processing wood fibers in a refiner and more particularly to an apparatus and method for refining wood fibers and breaking up fiber bundles.

BACKGROUND OF THE INVENTION

Disc-type refiners have traditionally been used to process wood fibers in a step of a paper product making process. Such refiners include first and second refining members having a refining space therebetween. Each of the first and second refining members include a plurality of refiner bars separated by refiner grooves, in which the refiner bars define cutting surfaces for cutting the wood fibers. During operation, at least one of the first and second refining members is rotated relative to the other, in which rotation of the cutting surfaces of the refiner bars cut wood fibers being processed in the refiner. Once the wood fibers are processed in the refiner, the processed wood fibers may be further processed in subsequent paper product making processes to produce paper products. In some instances, the wood fibers may undergo additional processing, such as in a separate tickler refiner or deflaker.

SUMMARY OF THE INVENTION

In accordance with a first aspect of the present invention, a refining member for a pulp refiner is provided. The refining member comprises a refining body including a refining surface comprising first refiner bars separated by first refiner grooves and second refiner bars separated by second refiner grooves. Each of the first refiner bars extends from a radially inward position on the refining surface to a first radially outward position on the refining surface. Each of the second refiner bars extends to a second radially outward position on the refining surface. The second refiner bars have a longitudinal length from about 0.6 cm to about 10 cm, in which the second radially outward position is nearer to an outermost part of the refining body than the first radially outward position. The first refiner bars have a first maximum height extending upward from a floor of an adjacent first refiner groove, and the second refiner bars have a second maximum height extending upward from a floor of an adjacent second refiner groove. The second maximum height is at least 0.35 mm less than the first maximum height. The first refiner bars are adapted to refine wood fibers, and the second refiner bars are adapted to break up fiber bundles.

The first maximum height of the first refiner bars, when measured from the floor of the adjacent first refiner groove, may be from about 4 mm to about 10 mm. The second maximum height of the second refiner bars, when measured from the floor of the adjacent second refiner groove, may be from about 0.35 mm to about 1.5 mm less than the first maximum height. The second maximum height of the second refiner bars, when measured from the floor of the adjacent second refiner groove, may be from about 0.7 mm to about 1.5 mm less than the first maximum height.

The longitudinal length of the second refiner bars may be from about 2 cm to about 10 cm.

The second refiner bars may be integral with the first refiner bars such that the second refiner bars extend from the first radially outward position to the second radially outward position. Each of the second refiner bars may slope continuously downward from the first radially outward position to the second radially outward position.

The first and second refiner bars may have a width extending between side edges of from about 2 mm to about 8 mm.

At least a portion of the first refiner grooves may be provided with dams.

The refining member may further comprise third refiner bars separated by third refiner grooves and fourth refiner bars separated by fourth refiner grooves. Each of the third refiner bars may extend to a third radially outward position on the refining surface, and each of the fourth refiner bars may extend to a fourth radially outward position on the refining surface. The fourth refiner bars may have a longitudinal length from about 0.6 cm to about 10 cm. The fourth radially outward position may be nearer to an outermost part of the refining body than the third radially outward position. The third refiner bars may have a third maximum height extending upward from a floor of an adjacent third refiner groove, and the fourth refiner bars may have a fourth maximum height extending upward from a floor of an adjacent fourth refiner groove. The fourth maximum height may be at least 0.35 mm less than the third maximum height. The third refiner bars may be adapted to refine wood fibers, and the fourth refiner bars may be adapted to break up fiber bundles.

The third refiner bars may be integral with the second refiner bars such that the third refiner bars extend from the second radially outward position to the third radially outward position, and the fourth refiner bars may be integral with the third refiner bars such that the fourth refiner bars extend from the third radially outward position to the fourth radially outward position.

In accordance with a second aspect of the present disclosure, a pulp refiner is provided. The pulp refiner comprises: a frame, at least a first pair of refining members, and a rotor associated with the frame. The refining members comprise a first refining member associated with the frame and comprising a first refining body and a second refining member associated with the frame and comprising a second refining body. The first refining body includes a first refining surface comprising: first refiner bars separated by first refiner grooves, each of the first refiner bars extending from a radially inward position on the refining surface to a first radially outward position on the refining surface, and second refiner bars separated by second refiner grooves, each of the second refiner bars extending to a second radially outward position on the refining surface. The second refiner bars have a longitudinal length from about 0.6 cm to about 10 cm. The second radially outward position may be nearer to an outermost part of the refining body than the first radially outward position. The first refiner bars have a first maximum height extending upward from a floor of an adjacent first groove, and the second refiner bars have a second maximum height extending upward from the adjacent second groove floor. The second maximum height is at least 0.35 mm less than the first maximum height. The second refining member includes a second refining surface comprising second member refiner bars separated by second member refiner grooves. The first refining member is spaced from the second refining member to define a refining space therebetween. The rotor is coupled to one of the first refining member or the second refining member such that rotation of the rotor effects movement of the one of the first or the second refining member relative to the other. When a slurry of wood pulp comprising wood fibers is supplied to the frame, the wood pulp slurry passes through the refining space such that a significant number of the wood fibers in the wood pulp slurry are refined and a plurality of wood fiber bundles in the wood pulp slurry are separated.

The second maximum height may be at least 0.7 mm less than the first maximum height.

The longitudinal length of the second refiner bars may be from about 2 cm to about 10 cm.

The second member refiner bars may comprise: third refiner bars extending from a radially inward position on the second refining surface to a first radially outward position on the second refining surface, and fourth refiner bars extending to a second radially outward position on the second refining surface. The second radially outward position may be nearer to an outermost part of the second refining body than the first radially outward position. The third refiner bars may have a third maximum height extending upward from a floor of an adjacent groove, and the fourth refiner bars may have a fourth maximum height extending upward from the adjacent groove floor. The fourth maximum height may be at least 0.35 mm less than the third maximum height.

The first refining member may be a non-rotating stator member, and the second refining member may be a rotating rotor member.

In accordance with a third aspect of the present disclosure, a method for processing wood fibers is provided. The method comprises: providing a refiner comprising at least a first pair of refining members. The refining members comprise: a first refining member comprising a first refining body and a second refining member comprising a second refining body. The first refining body includes a first refining surface comprising: first refiner bars separated by first refiner grooves and having a first maximum height extending upward from a floor of an adjacent first refiner groove, and second refiner bars separated by second refiner grooves and having a second maximum height extending upward from a floor of an adjacent second refiner groove. The second refining body includes a second refining surface comprising second member refiner bars separated by second member refiner grooves. The first refining member is spaced from the second refining member to define a refining space therebetween. At least a portion of the second member refiner bars are positioned so as to be across from the second refiner bars such that a gap between the portion of the second member refiner bars and the second refiner bars is defined. The method further comprises: rotating at least one of the first refining member or the second refining member such that the first and second refining members move relative to one another; supplying a slurry of wood pulp comprising wood fibers to the refiner such that the slurry passes through the refining space; and applying axial pressure to at least one of the first refining member or the second refining member as the slurry is supplied such that the gap between the portion of the second member refiner bars and the second refiner bars is between about 0.9 mm and about 1.5 mm, in which at least a portion of wood fiber bundles passing through the gap are separated.

The second refiner bars may have a longitudinal length from about 0.6 cm to about 10 cm, and the second maximum height may be at least 0.35 mm less than the first maximum height. The longitudinal length of the second refiner bars may be from about 2 cm to about 10 cm.

The second member refiner bars may comprise: third refiner bars and fourth refiner bars. The third refiner bars may have a third maximum height extending upward from a floor of an adjacent groove, and the fourth refiner bars may have a fourth maximum height extending upward from an adjacent groove floor. The fourth maximum height may be at least 0.35 mm less than the third maximum height.

In accordance with a fourth aspect of the present disclosure, a refining member for a pulp refiner is provided. The refining member comprises: a refining body comprising a plurality of radially extending pie-shaped segments comprising: at least one first pie-shaped segment and at least one second pie-shaped segment. The at least one first pie-shaped segment comprises a first refining surface comprising first refiner bars separated by first refiner grooves. The first refiner bars have a first maximum height extending upward from a floor of an adjacent first refiner groove. The at least one second pie-shaped segment comprises a second refining surface comprising second refiner bars separated by second refiner grooves. The second refiner bars have a second maximum height extending upward from a floor of an adjacent second refiner groove. The second maximum height is at least 0.35 mm less than the first maximum height. The first refiner bars are adapted to refine wood fibers, and the second refiner bars are adapted to break up fiber bundles.

The first maximum height of the first refiner bars, when measured from the floor of the adjacent first refiner groove, may be from about 4 mm to about 10 mm.

The second maximum height of the second refiner bars, when measured from the floor of the adjacent second refiner groove, may be from about 0.35 mm to about 1.5 mm less than the first maximum height.

The second maximum height of the second refiner bars, when measured from the floor of the adjacent second refiner groove, may be from about 0.7 mm to about 1.5 mm less than the first maximum height.

In accordance with a fifth aspect of the present disclosure, a pulp refiner is provided. The pulp refiner comprises: a frame, at least a first pair of refining members, and a rotor associated with the frame. The refining members comprise: a first refining member associated with the frame and comprising a first refining body and a second refining member associated with the frame and comprising a second refining body. The first refining body includes a plurality of radially extending pie-shaped segments comprising: at least one first pie-shaped segment and at least one second pie-shaped segment. The at least one first pie-shaped segment comprises a first refining surface comprising first refiner bars separated by first refiner grooves. The first refiner bars have a first maximum height extending upward from a floor of an adjacent first refiner groove. The at least one second pie-shaped segment comprises a second refining surface comprising second refiner bars separated by second refiner grooves. The second refiner bars have a second maximum height extending upward from a floor of an adjacent second refiner groove. The second maximum height is at least 0.35 mm less than the first maximum height. The second refining body includes a second member refining surface comprising second member refiner bars separated by second member refiner grooves. The first refining member is spaced from the second refining member to define a refining space therebetween. The rotor is coupled to one of the first refining member or the second refining member such that rotation of the rotor effects movement of the first and second refining members relative to one another. When a slurry of wood pulp comprising wood fibers is supplied to the frame, the wood pulp slurry passes through the refining space such that a significant number of the wood fibers in the wood pulp slurry are refined and a plurality of wood fiber bundles in the wood pulp slurry are separated.

The second maximum height of the second refiner bars, when measured from the floor of the adjacent second refiner groove, may be from about 0.35 mm to about 1.5 mm less than the first maximum height.

The second maximum height of the second refiner bars, when measured from the floor of the adjacent second refiner groove, may be from about 0.7 mm to about 1.5 mm less than the first maximum height.

The second refining body may comprise a plurality of radially extending pie-shaped segments comprising: at least one third pie-shaped segment and at least one fourth pie-shaped segment. The at least one third pie-shaped segment may comprise a third refining surface comprising third refiner bars separated by third refiner grooves. The third refiner bars may have a third maximum height extending upward from a floor of an adjacent third refiner groove. The at least one fourth pie-shaped segment may comprise a fourth refining surface comprising fourth refiner bars separated by fourth refiner grooves. The fourth refiner bars may have a fourth maximum height extending upward from a floor of an adjacent fourth refiner groove. The fourth maximum height may be at least 0.35 mm less than the third maximum height. The third and fourth refiner bars may define the second member refiner bars, and the third and fourth refiner grooves may define the second member refiner grooves.

The first refining member may be a non-rotating stator member, and the second refining member may be a rotating rotor member.

In accordance with a sixth aspect of the present disclosure, a refining member for a pulp refiner is provided. The refining member comprises a refining body including a refining surface comprising: refiner bars separated by refiner grooves, each of the refiner bars extending from a radially inward position on the refining surface to a first radially outward position on the refining surface; and teeth extending to a second radially outward position on the refining surface. The second radially outward position is nearer to an outermost part of the refining body than the first radially outward position. The refiner bars are adapted to refine wood fibers and the teeth are adapted to break up fiber bundles.

The refiner bars may have a first maximum height, when measured from a floor of an adjacent refiner groove, from about 4 mm to about 10 mm.

The refiner bars may have a width extending between side edges of from about 2 mm to about 8 mm.

At least a portion of the refiner grooves may be provided with dams.

In accordance with a seventh aspect of the present disclosure, a pulp refiner is provided. The pulp refiner comprises a frame, at least a first pair of refining members, and a rotor associated with the frame. The refining members comprise a first refining member associated with the frame and comprising a first refining body including a first refining surface and a second refining member associated with the frame and comprising a second refining body including a second refining surface. The first refining surface comprises: first refiner bars separated by first refiner grooves, each of the first refiner bars extending from a radially inward position on the first refining surface to a first radially outward position on the first refining surface, and first teeth extending to a further radially outward position on the first refining surface. The further radially outward position is nearer to an outermost part of the first refining body than the first radially outward position. The first refining member is spaced from the second refining member to define a refining space therebetween. The rotor is coupled to one of the first refining member or the second refining member such that rotation of the rotor effects movement of the first and second refining members relative to one another. When a slurry of wood pulp comprising wood fibers is supplied to the frame, the wood pulp slurry passes through the refining space such that a significant number of the wood fibers in the wood pulp slurry are refined and a plurality of wood fiber bundles in the wood pulp slurry are separated.

The second refining member may comprise a second refining body including a second refining surface comprising: second refiner bars separated by second refiner grooves, each of the second refiner bars extending from a radially inward position on the second refining surface to a first radially outward position on the second refining surface, and second teeth extending to a second radially outward position on the second refining surface. The second radially outward position may be nearer to an outermost part of the second refining body than the first radially outward position.

The second refining surface may comprise a first row of the second teeth extending to the second radially outward position on the second refining surface and a second row of the second teeth extending to a fourth radially outward position on the second refining surface. The first teeth intermesh with the second teeth.

The first refining member may be a non-rotating stator member, and the second refining member may be a rotating rotor member.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIGS. 2 and 3 are plan views of a first and a second refining body, respectively;

FIGS. 4A and 4B are plan views of a section of a refining surface of the first refining body of FIG. 2;

FIGS. 13 and 14 are plan views of a first and a second refining body, respectively, comprising teeth;

FIG. 15 is a plan view of a section of a refining surface of the first refining body of FIG. 13;

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
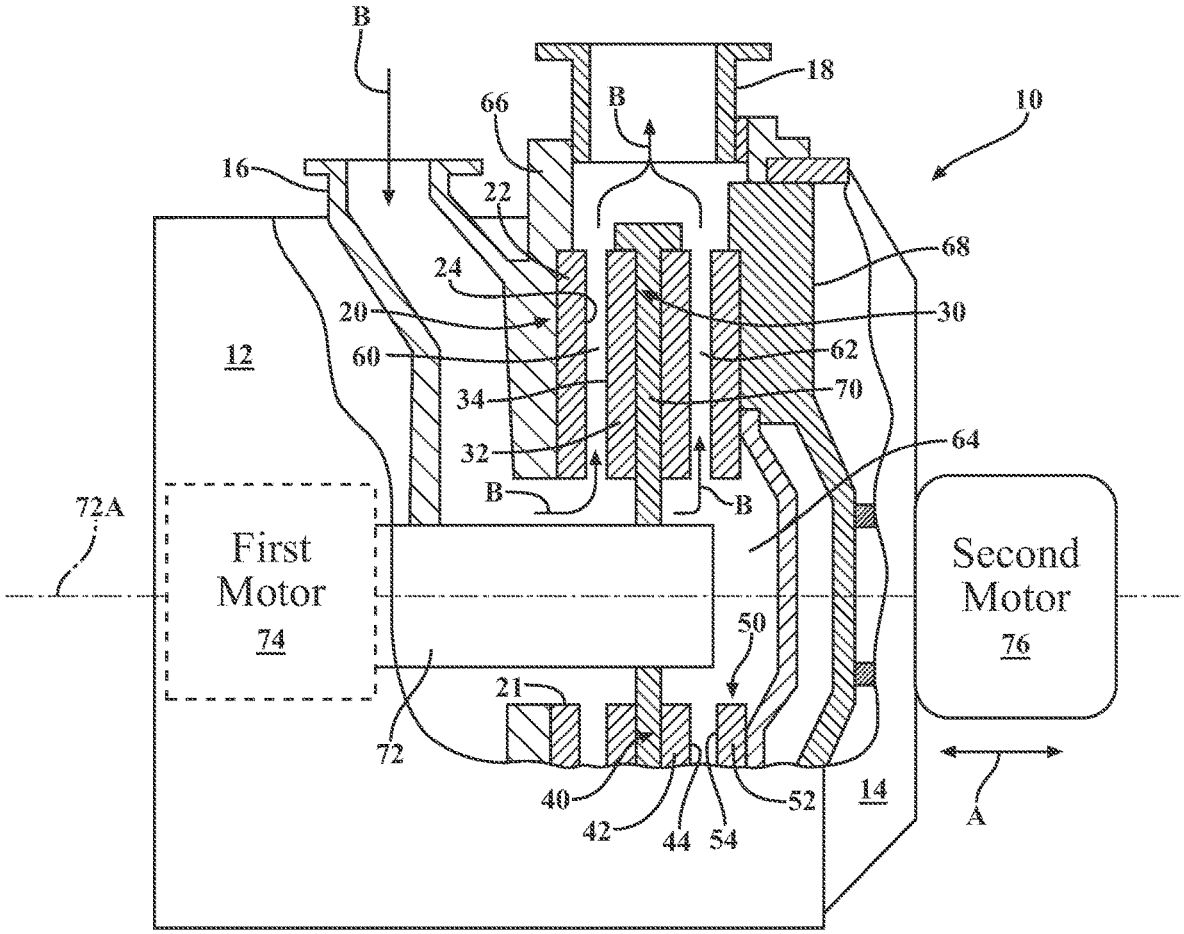
FIG. 1 is a schematic, partial cross-sectional view of a disc refiner.

FIG. 1 illustrates a schematic, partial cross-sectional view of a disc refiner 10 according to the present disclosure. The disc refiner 10 comprises a housing with a first housing section 12 and a second housing section 14 that may be bolted or otherwise attached fixedly together. The housing sections 12, 14 define an inlet 16, an outlet 18, and a refiner inner cavity 64 that contains one or more pairs of refining members. The embodiment shown in FIG. 1 is a double-disc refiner 10 comprising two pairs of refining members, e.g., a first refining member 20 paired with a second refining member 30 and a third refining member 40 paired with a fourth refining member 50. The first refining member 20 comprises a first refining body 22 with a first refining surface 24, and the second refining member 30 comprises a second refining body 32 with a second refining surface 34. The third refining member 40 comprises a third refining body 42 and a third refining surface 44, and the fourth refining member 50 comprises a fourth refining body 52 and a fourth refining surface 54. Each of the refining members 20, 30, 40, 50 are associated with a main support frame comprising a fixed support frame 66 secured to the first housing section 12 and a movable support frame 68, as described herein.

The first, second, third, and fourth refining bodies 22, 32, 42, 52 may be generally disc-shaped with substantially identical outer diameters (see FIGS. 2 and 3). The first and second refining members 20, 30 are arranged such that the first refining surface 24 faces the second refining surface 34, and the third and fourth refining members 40, 50 are arranged such that the third refining surface 44 faces the fourth refining surface 54. The first refining member 20 is spaced apart from the second refining member 30 to define a first refining space 60 between the respective refining surfaces 24, 34. The third refining member 40 is spaced apart from the fourth refining member 50 to define a second refining space 62 between the respective refining surfaces 44, 54. The disc refiner 10 may have a structure similar to the one illustrated in U.S. Patent Application Publication No. 2006/0037728 A1, the disclosure of which is incorporated herein by reference.

In the embodiment shown in FIG. 1, the first and fourth refining members 20, 50 are stationary, and the second and third refining members 30, 40 rotate relative to the first and fourth refining members 20, 50. The first refining member 20 may be fixed to the support frame 66 by bolts or other suitable fasteners (not shown). The second and third refining members 30, 40 may be attached to a support 70 that is coupled to and extends radially outwardly from a rotatable shaft 72. The support 70 is coupled to the shaft 72 so as to rotate with the shaft 72 and is also axially movable along the shaft 72. The shaft 72 is driven by a first motor 74 such that the support 70 and the second and third refining members 30, 40 rotate with the shaft 72 during operation of the disc refiner 10. The shaft 72 has a central axis 72A that is generally coaxial with an axis of rotation of the second and third refining members 30, 40. The shaft 72 may be rotatably mounted to the fixed support frame 66 such that the first and second refining members 30, 40 are associated with the main support frame. The support 70 may be movable axially along the shaft 72, e.g., substantially along the central axis 72A, relative to the first and fourth refining members 20, 50, as described herein. The fourth refining member 50 may be fixed to the movable support frame 68 by bolts or other suitable fasteners (not shown). Thus, the support 70 and the shaft 72 may define a rotor associated with the main support frame such that the second and third refining members may define rotating rotor members, and the first and fourth refining members 20, 50 may define non-rotating stator members. Rotation of the rotor effects movement of the second and third refining members 30, 40 relative to the first and fourth refining members 20, 50, respectively.

The movable support frame 68 may be mounted in the second housing section 14 and is coupled to a second motor 76, which may comprise a reversible electric motor, which is fixed in position. The second motor 76 moves the movable support frame 68 in a substantially horizontal (i.e., axial) direction shown by arrow A. The refiner 10 may comprise, for example, a jack screw (not shown) coupled to the second motor 76 and the movable support frame 68, which second motor 76 may rotate the jack screw to move the movable support frame 68 to which is attached, for example, the fourth refining member 50. This movement adjusts the size of the gaps, i.e., the first and second refining spaces 60, 62, defined between the first and second refining members 20, 30 and the third and fourth refining members 40, 50 (see also FIGS. 8 and 9). In other embodiments (not shown), control of the size of the gaps may be achieved by one or more magnetic bearings. Magnetic bearings that control the axial position of the shaft 72 may be used to control the position of the rotating rotor members that are fixed to the shaft 72. Magnetic bearings may be used to control the axial position of one or more additional movable sections of the main support frame, i.e., the movable support frame 68, to which one or more of the non-rotating stator members are attached.

As will be discussed further herein, a slurry of wood pulp comprising wood fibers passes through the refining spaces 60, 62. As the jack screw rotates in a first direction, it causes movement of the movable support frame 68 and the fourth refining member 50 inwardly towards the third refining member 40. The fourth refining member 50 then applies an axial force to the pulp slurry passing through the second refining space 62 which, in turn, applies an axial force to the third refining member 40, causing the third refining member 40, the support 70 and the second refining member 30 to move inwardly toward the first refining member 20. As the jack screw rotates in a second direction, opposite to the first direction, it causes movement of the movable support frame 68 and the fourth refining member 50 outwardly away from the third refining member 40. This reduces the axial force applied by the fourth refining member 50 to the pulp slurry passing through the second refining space 62 which, in turn, reduces an axial force applied by the pulp slurry to the third refining member 40. The axial force applied by the pulp slurry passing through the first refining space 60 is then sufficient to cause the second refining member 30, the support 70 and the third refining member 40 to move toward the fourth refining member 50. This occurs until the axial forces applied by the wood slurries passing through the first and second refining spaces 60, 62 against the second and third refining members 30 and 40 are approximately equal.

In some embodiments (not shown), the disc refiner 10 may further comprise a further motor and a second rotatable shaft, and the first and/or fourth refining members 20, 50 may be coupled to the second rotatable shaft such that the first and/or fourth refining members 20, 50 may be counter-rotatable relative to the second and/or third refining members 30, 40, respectively. In other embodiments (not shown), the disc refiner 10 may comprise only one pair of refining members in which one refining member is a non-rotating stator member and the other refining member is a rotating rotor member. In further embodiments (not shown), the disc refiner may comprise three or more pairs of refining members. In yet further embodiments (not shown), the disc refiner 10 may comprise a conical refiner with one or more pairs of refining members.

FIGS. 2 and 3 are plan views of the refining surfaces 24, 34 of the first refining body 22 and the second refining body 32, respectively, for use in a pulp refiner according to one embodiment of the present disclosure. Although not discussed in detail herein, the structure of the refining surfaces 44, 54 of the third and fourth refining bodies 42, 52, respectively, (see FIG. 1) may be substantially similar to the refining surfaces 24, 34 of the first and second refining bodies 22, 32, respectively.

With reference to FIGS. 1 and 2, the first refining body 22 may comprise a plurality of sections, e.g. sections 22A-22C, that are bolted or otherwise attached together to form the disc-shaped refining body 22 comprising a radially outer edge 27. The refining surface 24 comprises a plurality of elongated refiner bars 26 separated from one another by refiner grooves 28. Although not shown in FIG. 2, it is understood that the other sections (not labeled) of the first refining body 22 would similarly comprise refiner bars 26 and refiner grooves 28. The refiner bars 26 extend radially outwardly from a radially inner location 23 toward the radially outer edge 27 of the first refining body 22. The refiner bars 26 may be slanted at various angles as shown in FIG. 2, and each section 22A-22C may comprise one or more segments (not separately labeled) of refiner bars 26 that are slanted in different directions. The refiner bars 26 and refiner grooves 28 within each section 22A-22C in FIG. 2 may otherwise be similar in structure.

As shown in FIG. 3, the second refining body 32 may similarly comprise a plurality of sections, e.g. sections 32A-32C, that are bolted or otherwise attached together to form the disc-shaped refining body 32 comprising a radially outer edge 37. The refining surface 34 comprises a plurality of elongated refiner bars 36 separated from one another by refiner grooves 38. Although not shown in FIG. 3, it is understood that the other sections (not labeled) of the second refining body 32 would similarly comprise refiner bars 36 and refiner grooves 38. The refiner bars 36 extend radially outwardly from a radially inner location 33 toward the radially outer edge 37 of the second refining body 32. The refiner bars 36 may be slanted at various angles as shown in FIG. 3, and each section 32A-32C may comprise two or more segments (not separately labeled) of refiner bars 36 that are slanted in different directions. The refiner bars 36 and refiner grooves 38 within each section 32A-32C in FIG. 3 may otherwise be similar in structure.

Paths of a slurry of wood pulp comprising wood fibers through the refiner 10 are illustrated via arrows B in FIG. 1. With reference to FIGS. 1-3, the pulp slurry enters the disc refiner 10 through an inlet 16 and passes into the refiner inner cavity 64 via a central aperture 21 in the first refining member 20. The refiner inner cavity 64 may be defined, in part, by the fixed support frame 66 and the movable support frame 68. The refining surfaces 24, 34 may comprise one or more additional rows of refiner bars (not labeled), such as those located near the center of the refining bodies 22, 32, e.g., near the central aperture 21. These additional refiner bars may be wider and spaced further apart than the other refiner bars 26 to break up large fiber bundles before they enter the refining space 60. The wood fibers travel radially outwardly between the refining members 20, 30, 40, 50. The first refining space 60 defined between the first and second refining members 20, 30 and the second refining space 62 defined between the third and fourth refining members 40, 50 define separate paths along which the wood fibers may travel from the inlet 16 to the outlet 18. It is believed that the wood fibers only pass through one of the first and second refining spaces 60, 62 at a time. The refiner grooves 28, 38 may be considered part of the refining space 60 defined between the first and second refining members 20, 30. It is believed that a majority of the flow of the wood fibers through the refining space 60 passes through the refiner grooves 28, 38. Similarly, the refiner grooves (not shown) of the third and fourth refining members 40, 50 may be considered part of the refining space 62 defined between the third and fourth refining members 40, 50. It is believed that a majority of the flow of wood fibers through the refining space 62 passes through the refiner grooves (not labeled) of the third and fourth refining members 40, 50. After processing, the wood fibers exit the refiner 10 via the outlet 18, at least in part under the action of centrifugal force.

Figure 4B:
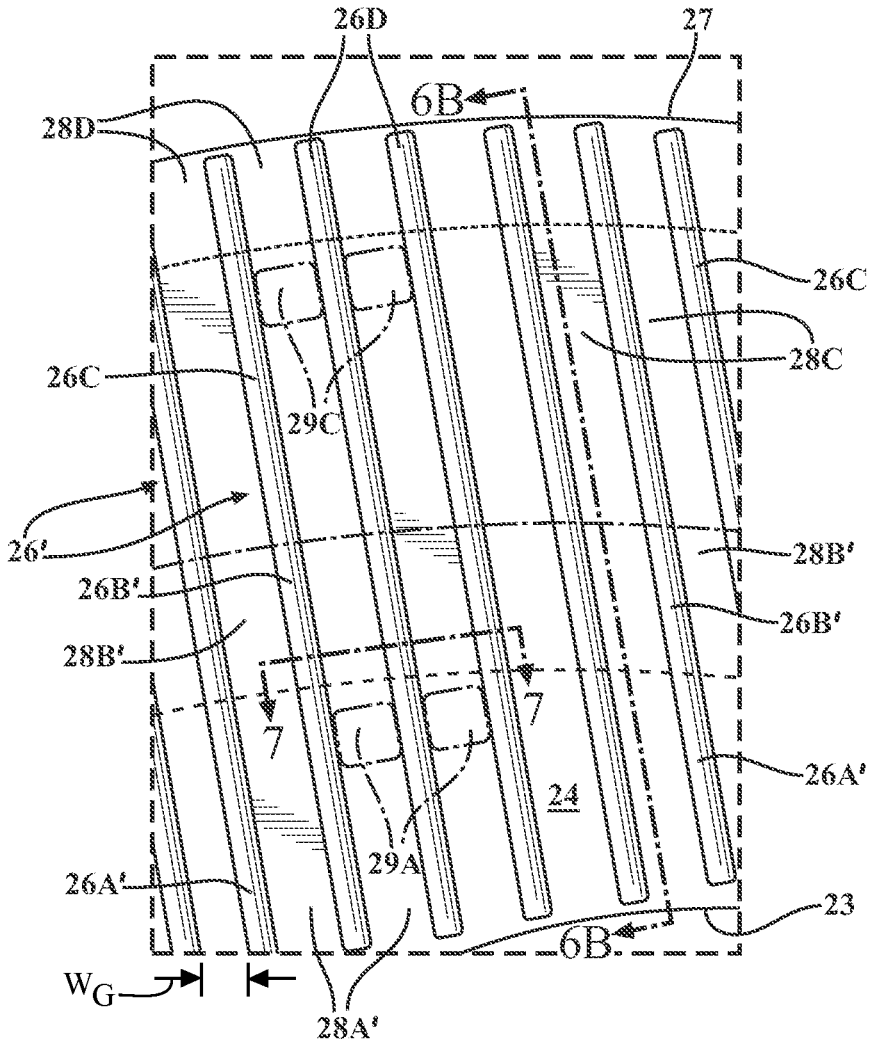
Figure 5A:
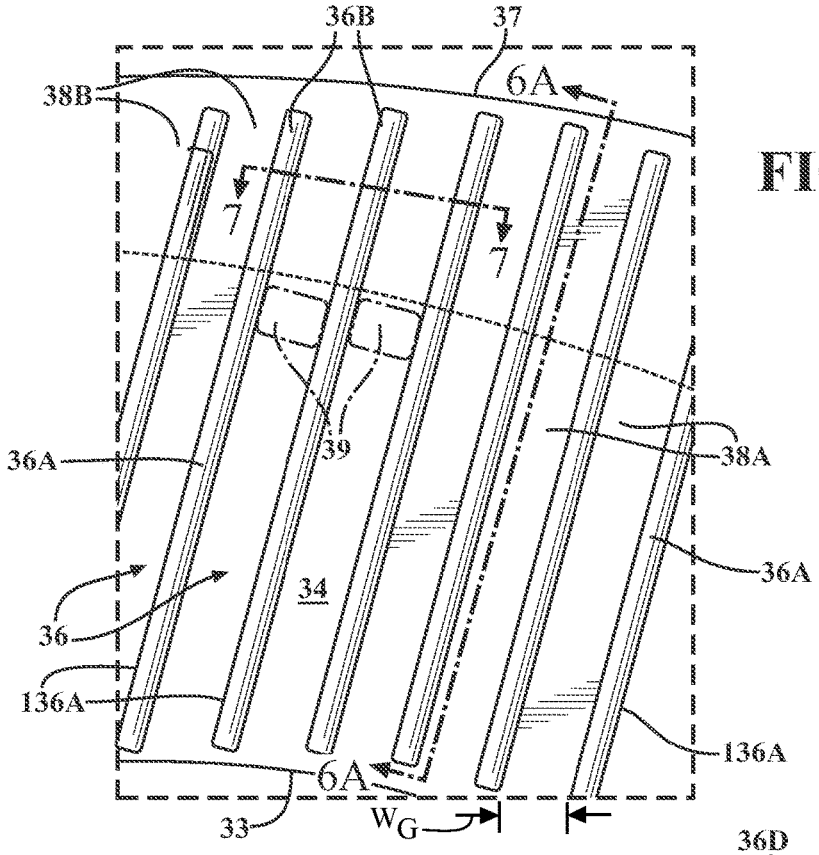
FIGS. 5A and 5B are plan views of a section of a refining surface of the second refining body of FIG. 3.
Figure 5B:
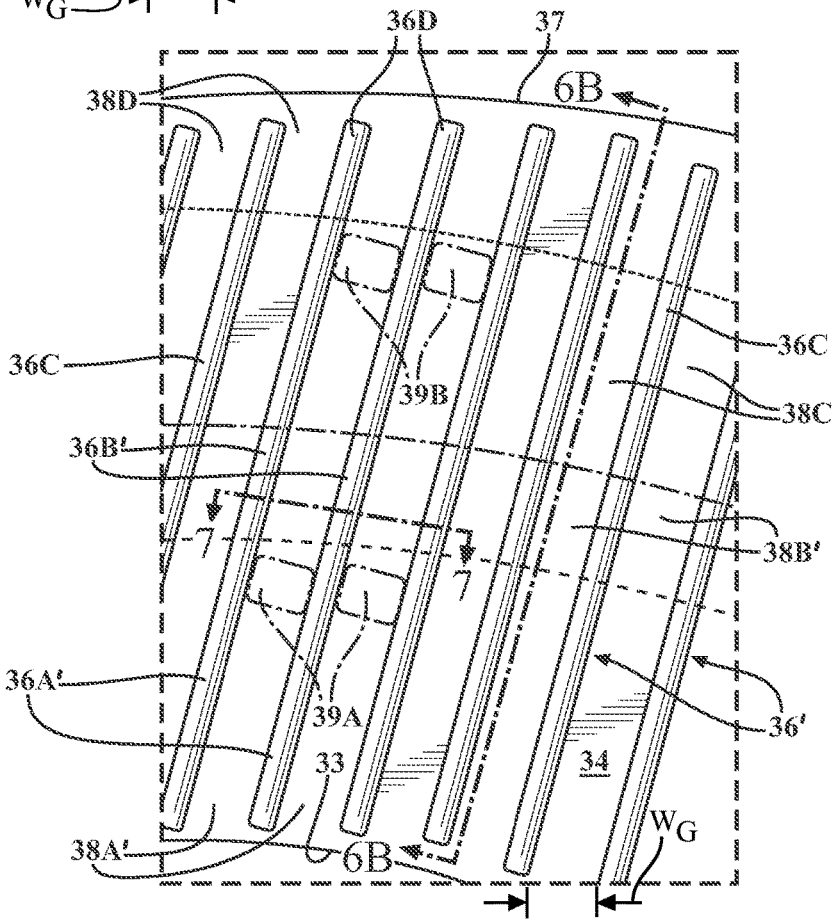
Figure 6A:
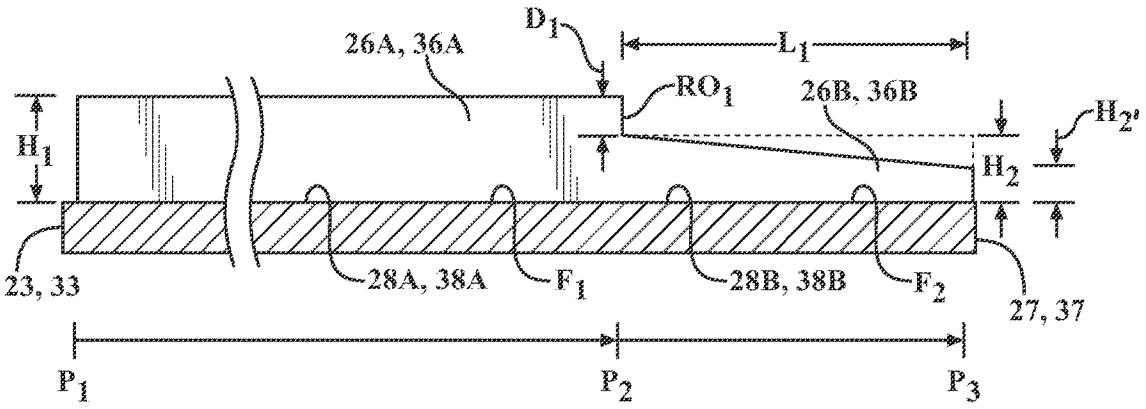
FIG. 6A is a partial cross-sectional view of a refining body taken along line 6A-6A in FIGS. 4A and 5A.
Figure 6B:
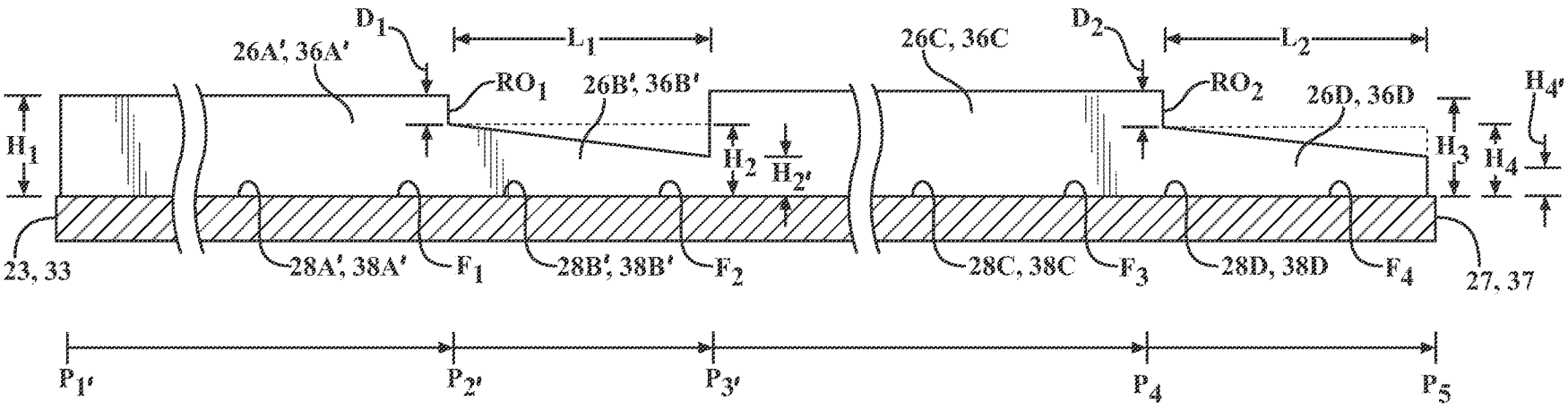
FIG. 6B is a partial cross-sectional view of a refining body taken along line 6B-6B in FIGS. 4B and 5B.
Figure 7:
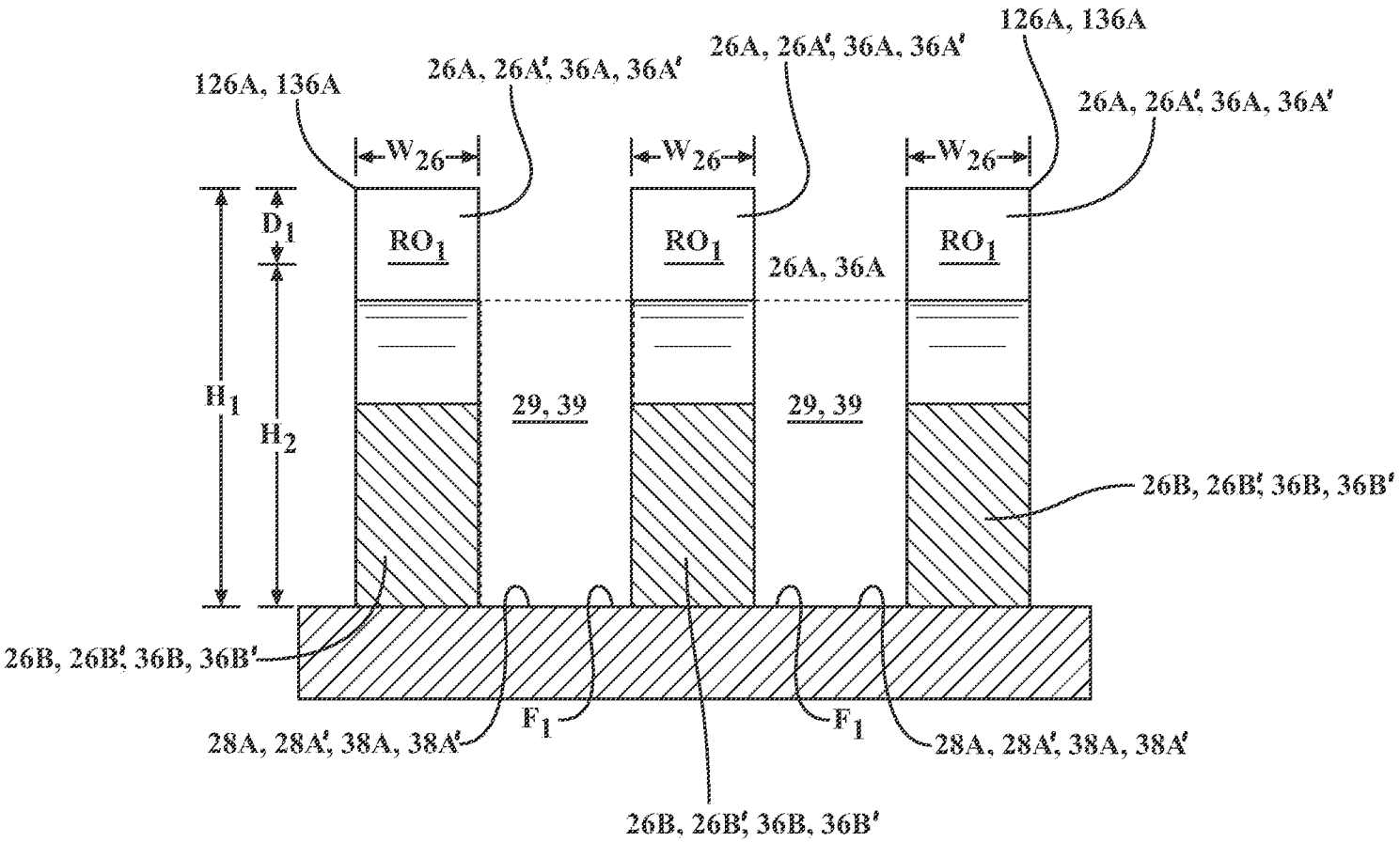
FIG. 7 is a partial cross-sectional view taken along line 7-7 in FIGS. 4A, 4B, 5A, and 5B.

FIGS. 4A and 4B are detailed views of one portion of the refining surface 24 of the first refining body 22, and FIGS. 5A and 5B are detailed views of a corresponding portion of the refining surface 34 of the second refining body 32. FIGS. 6A and 6B are partial cross-sectional views of the refining bodies 22, 32 taken along lines 6A-6A and 6B-6B, respectively, illustrating two embodiments of a refiner bar 26, 36, as shown in FIGS. 4A, 4B, 5A, and 5B. FIG. 7 is a partial cross-sectional view taken along line 7-7 in FIGS. 4A, 4B, 5A, and 5B.

In the embodiments shown in FIGS. 4A, 5A, 6A, and 7, each refiner bar 26, 36 may comprise a first refiner bar 26A, 36A and a second refiner bar 26B, 36B. The first refiner bars 26A, 36A may be separated from one another by first refiner grooves 28A, 38A, and the second refiner bars 26B, 36B may be separated from one another by second refiner grooves 28B, 38B. The first and second refiner grooves 28A, 38A, 28B, 38B may have a width $W_G$ of from about 2 mm to about 6 mm. As shown in FIGS. 6A and 7, the first refiner bars 26A, 36A comprise a first maximum height $H_1$ extending upward from a floor $F_1$ of the adjacent first refiner groove 28A, 38A, and the second refiner bars 26B, 36B comprise a second maximum height $H_2$ extending upward from a floor Fa of the adjacent second refiner groove 28B, 38B, in which the second maximum height $H_2$ is less than the first maximum height $H_1$. The minimum height difference between $H_1$ and $H_2$ is depicted as Di in FIG. 6A. In some examples, a radially outer portion $RO_1$ of the first refiner bar 26A, 36A may comprise a step-down from the first maximum height $H_1$ to the second maximum height $H_2$.

In some examples, the second maximum height $H_2$ may be at least 0.35 mm less than the first maximum height $H_1$. In other examples, the second maximum height $H_2$ may be at least 0.70 mm less than the first maximum height $H_1$. In further examples, the first maximum height $H_1$ of the first refiner bars 26A, 36A, when measured from the floor $F_1$ of the adjacent first refiner groove 28A, 38A, may be from about 4 mm to about 10 mm. In a particular example, the second maximum height $H_2$ of the second refiner bars 26B, 36B, when measured from the floor Fa of the adjacent second refiner groove 28B, 38B, may be from about 0.35 mm to about 1.5 mm less than the first maximum height $H_1$. In another particular example, the second maximum height $H_2$ of the second refiner bars 26B, 36B, when measured from the floor $F_2$ of the adjacent second refiner groove 28B, 38B, may be from about 0.7 mm to about 1.5 mm less than the first maximum height $H_1$. In further examples, the first refiner bars 26A, 36A and the second refiner bars 26B, 36B may comprise a width $W_{26}$ extending between sides edges of the respective refiner bars 26A, 36A, 26B, 36B of from about 2 mm to about 8 mm.

Each of the first refiner bars 26A, 36A extend from a radially inward position $P_1$ on the refining surface 24, 34 to a first radially outward position $P_2$ on the refining surface 24, 34. Each of the second refiner bars 26B, 36B extend to a second radially outward position $P_3$ on the refining surface 24, 34. The second radially outward position $P_3$ may be nearer to an outermost part, e.g., the radially outer edge 27, 37, of the refining body 22, 32 than the first radially outward position $P_2$. In some examples, the radially inward position $P_1$ may comprise a position at or near the radially inner location 23, 33. The second refiner bars 26B, 36B may comprise a longitudinal length $L_1$ from about 0.6 cm to about 10 cm and preferably from about 2 cm to about 10 cm.

In some embodiments, the second refiner bars 26B, 36B may be integral with the first refiner bars 26A, 36A, as shown in FIGS. 4A, 5A, and 6A, such that the second refiner bars 26B, 36B extend from the first radially outward position $P_2$ to the second radially outward position $P_3$. In a particular embodiment, the second refiner bars 26B, 36B may slope continuously downward from the first radially outward position $P_2$ to the second radially outward position $P_3$. As shown in FIG. 6A, the height of the second refiner bars 26B, 36B may decrease continuously along substantially the entire longitudinal length $L_1$ from the second maximum height $H_2$ to a second minimum height $H_2'$. In another particular embodiment, the second refiner bars 26B, 36B may extend substantially horizontally from the first radially outward position $P_2$ to the second radially outward position $P_3$, as depicted by the dashed line in FIG. 6A, such that the second refiner bars 26B, 36B are at the second maximum height $H_2$ along substantially the entire longitudinal length $L_1$ of the second refiner bars 26B, 36B. In other embodiments (not shown), the first refiner bars 26A, 36A may be radially separated from the second refiner bars 26B, 36B by a space.

With reference to FIGS. 4A, 5A, and 7, the refining surfaces 24, 34 may comprise dams 29, 39 provided in at least a portion of the first refiner grooves 28A, 38A. The dams 29, 39 may comprise a height that is substantially the same as or less than the height of the adjacent first refiner bars 26A, 36A. The dams 29, 39 serve to divert wood fibers from the first refiner grooves 28A, 38A so as to be engaged by the first and second refiner bars 26A, 36A, 26B, 36B.

With reference to FIGS. 1, 4A, 5A, and 6A, when a slurry of wood pulp comprising wood fibers is supplied to the frame 66, e.g., the inlet 16, of the refiner 10, the first refiner bars 26A, 36A are adapted to refine the wood fibers in the pulp slurry, while the second refiner bars 26B, 36B are adapted to break up or separate fiber bundles. Refining may be used to break apart and reduce small flocs of fibers, induce external or internal fibrillation to effect fiber bonding, and/or cut a significant number of long wood fibers in the wood pulp slurry such that the lengths of the long wood fibers are reduced. However, the refining process also causes some of the wood fibers to re-form into small, dense fiber bundles ("flakes"), particularly during refining of long fibers such as softwood. The fiber bundles may adversely affect tensile strength, formation, etc. of the finished paper product, seed formation of strings of pulp that clog downstream components, and/or inhibit the drainage of fluid/water from the fibers during paper product production. Thus, the flakes should be broken apart after refining in a process called deflaking. As used herein, the term "deflaking" is used to refer to the process of breaking apart fiber bundles that have formed during refining. When refining involves a conventional pulp refiner, deflaking typically takes place in one or more subsequent refiners, frequently operating at low power and referred to as a "tickler" refiner, or deflakers. Use of separate refiner(s) or deflakers increases the cost and complexity of the system. In addition, the tickler refiner(s) and the associated lines and tank(s) and a downstream machine chest may accumulate residual amounts of fibers from previous runs and allow the continued formation of fiber bundles. Processing in the tickler refiner(s) may degrade the properties of the fibers when dissimilar pulp slurries are refined together. It is believed that refining members 20, 30, 40, 50 according to the present disclosure solve these problems by incorporating refiner bars 26A, 26B, 36A, 36B of differing heights such that refining and deflaking may be performed within a single refiner 10.

Figure 8:
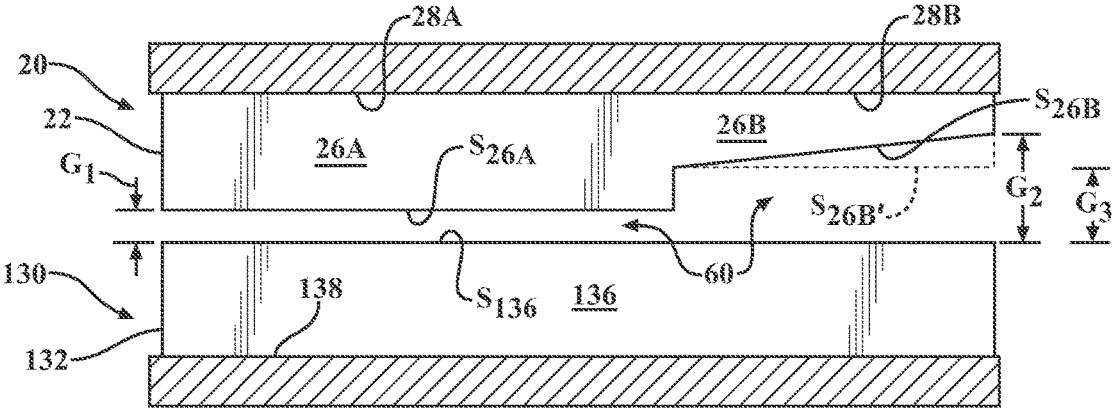
FIGS. 8 and 9 are partial cross-sectional views of a refiner bar on a first refining body that is spaced apart and positioned above a corresponding refiner bar on a second refining body.
Figure 9:
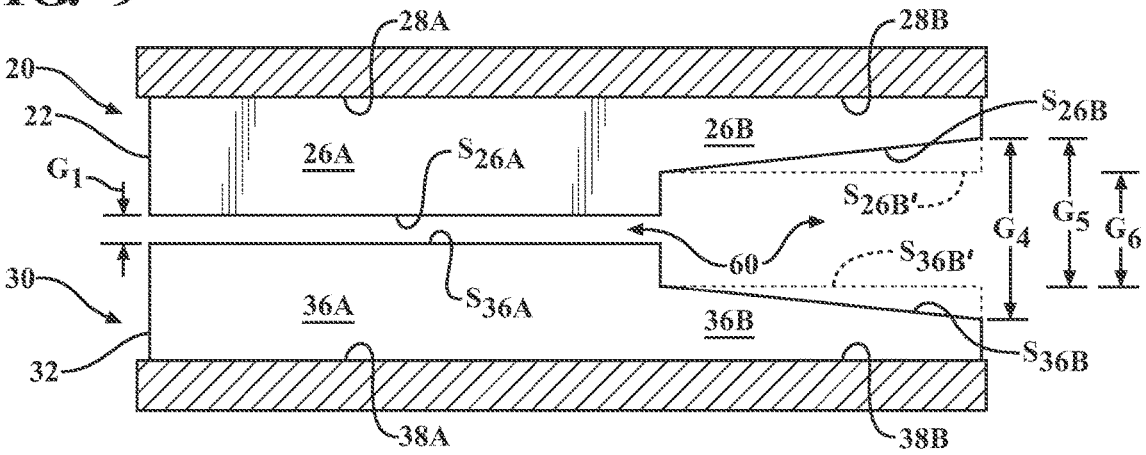

The first maximum height $H_1$ of the first refiner bars 26A, 36A, which is greater than the second maximum height $H_2$, means that the wood fibers are subjected to high intensity shearing and compression forces as the fibers pass through the portion of the refining space 60 that is at least partially defined by the first refiner grooves 28A, 38A and engaged by cutting side edges 126A, 136A of the first refiner bars 26A, 36A on the opposing first and second refining surfaces 24, 34 (see also FIGS. 8 and 9). Hence, the portion of the refining space 60 that is at least partially defined by the first refiner grooves 28A, 38A and extends from the radially inward position $P_1$ on the refining surface 24, 34 to the first radially outward position $P_2$ on the refining surface 24, 34 may at least partially define a refining zone. In some examples, the radially inner location 23, 33 of the respective refining body 22, 32 may define the start of the refining zone. When the refined fibers pass into the portion of the refining space 60 that is at least partially defined by the second refiner grooves 28B, 38B (e.g., from about the first radially outward position $P_2$ to about the second radially outward position $P_3$ in FIG. 6A), the second refiner bars 26B, 36B comprise the second maximum height $H_2$, and the intensity of the force applied to the fibers decreases in response to the reduced height (see also FIGS. 8 and 9). Thus, the portion of the refining space 60 that is at least partially defined by the second refiner grooves 28B, 38B and extends from the first radially outward position $P_2$ to the second radially outward position $P_3$ on the refining surface 24, 34 may at least partially define a deflaking zone. The decreased force applied to the fibers in the deflaking zone is believed to break up the fiber bundles formed during refining without further refining or only minimally refining the fibers. In the embodiment depicted in FIG. 6A, the second refiner bars 26B, 36B form an annular ring defining the deflaking zone around a radially outer portion (not separately labeled) of the first and second refining bodies 22, 32. It is believed that the second maximum height $H_2$ of the second refiner bars 26B, 36B should be at least about 0.35 mm less than the first maximum height $H_1$ of the first refiner bars 26A, 36A in order to cease refining of the fibers and begin deflaking. The refining zone may comprise 60% or more of the total area defined by both the refining and deflaking zones on each refining surface 24, 34.

In the embodiments shown in FIGS. 4B, 5B, and 6B, each refiner bar 26', 36' may comprise a first refiner bar 26A', 36A', a second refiner bar 26B', 36B', a third refiner bar 26C, 36C, and a fourth refiner bar 26D, 36D. The first refiner bars 26A', 36A' and the second refiner bars 26B', 36' may be substantially similar to the first refiner bars 26A, 36A and the second refiner bars 26B, 36B as depicted in FIGS. 4A, 5A, 6A, and 7 and as described herein but the first and second refiner bars 26A', 36A', 26B', 36B' may extend radially outwardly a shorter distance. The first refiner bars 26A', 36A' may be separated from one another by first refiner grooves 28A', 38A', and the second refiner bars 26B', 36B' may be separated from one another by second refiner grooves 28B', 38B'. The first and second refiner grooves 28A', 38A', 28B', 38B' may have a width $W_G$ of from about 2 mm to about 6 mm. The third refiner bars 26C, 36C may be separated from one another by third refiner grooves 28C, 38C, and the fourth refiner bars 26D, 36D may be separated from one another by fourth refiner grooves 28D, 38D. As shown in FIG. 6B, the third refiner bars 26C, 36C comprise a third maximum height $H_3$ extending upward from a floor $F_3$ of the adjacent third refiner groove 28C, 38C, and the fourth refiner bars 26D, 36D comprise a fourth maximum height $H_4$ extending upward from a floor $F_4$ of the adjacent fourth refiner groove 28D, 38D, in which the fourth maximum height $H_4$ is less than the third maximum height $H_3$. The third maximum height $H_3$ may substantially equal the first maximum height $H_1'$ and the fourth maximum height $H_4$ may substantially equal the second maximum height $H_2$. The minimum height difference between $H_3$ and $H_4$ is depicted as Da in FIG. 6B. In some examples, a radially outer portion $RO_2$ of the third refiner bar 26C, 36C may comprise a step-down from the third maximum height $H_3$ to the fourth maximum height $H_4$. The third and fourth refiner grooves 28C, 38C, 28D, 38D may have a width $W_G$ of from about 2 mm to about 6 mm.

In some examples, the fourth maximum height $H_4$ may be at least 0.35 mm less than the third maximum height $H_3$. In other examples, the fourth maximum height $H_4$ may be at least 0.70 mm less than the third maximum height $H_3$. In further examples, the third maximum height $H_3$ of the third refiner bars 26C, 36C, when measured from the floor $F_3$ of the adjacent third refiner groove 28C, 38C, may be from about 4 mm to about 10 mm. In a particular example, the fourth maximum height $H_4$ of the fourth refiner bars 26D, 36D, when measured from the floor $F_4$ of the adjacent fourth refiner groove 28D, 38D, may be from about 0.35 mm to about 1.5 mm less than the third maximum height $H_3$. In another particular example, the fourth maximum height $H_4$ of the fourth refiner bars 26D, 36D, when measured from the floor $F_4$ of the adjacent fourth refiner groove 28D, 38D, may be from about 0.7 mm to about 1.5 mm less than the third maximum height $H_3$. In further examples, the third refiner bars 26C, 36C and the fourth refiner bars 26D, 36D may comprise a width (not separately labeled) extending between sides edges of the respective refiner bars 26C, 36C, 26D, 36D of from about 2 mm to about 8 mm.

Each of the first refiner bars 26A', 36A' extends from a radially inward position $P_1'$ on the refining surface 24, 34 to a first radially outward position $P_2'$ on the refining surface 24, 34. Each of the second refiner bars 26B', 36B' extends to a second radially outward position $P_3'$ on the refining surface 24, 34. Each of the third refiner bars 26C, 36C extend to a third radially outward position $P_4$ on the refining surface 24, 34. Each of the fourth refiner bars 26D, 36D extend to a fourth radially outward position $P_5$ on the refining surface 24, 34. The fourth radially outward position $P_5$ may be nearer to an outermost part, e.g., the radially outer edge 27, 37, of the refining body 22, 32 than the first, second, and third radially outward positions $P_2'$, $P_3'$ and $P_4$. The fourth refiner bars 26D, 36D may comprise a longitudinal length $L_2$ from about 0.6 cm to about 10 cm and preferably from about 2 cm to about 10 cm.

In some embodiments, the second refiner bars 26B', 36B' may be integral with the first refiner bars 26A', 36A', as shown in FIGS. 4B, 5B, and 6B, such that the second refiner bars 26B', 36B' extend from the first radially outward position $P_2'$ to the second radially outward position $P_3'$.

In some embodiments, as shown in FIGS. 4B, 5B, and 6B, the third refiner bars 26C, 36C may be integral with the second refiner bars 26B', 36B' such that the third refiner bars 26C, 36C extend from the second radially outward position $P_3'$ to the third radially outward position $P_4'$ and the fourth refiner bars 26D, 36D may be integral with the third refiner bars 26C, 36C such that the fourth refiner bars 26D, 36D extend from the third radially outward position $P_4$ to the fourth radially outward position $P_5$. In a particular embodiment, the second refiner bars 26B', 36B' may slope continuously downward from the first radially outward position $P_2'$ to the second radially outward position $P_3'$. As shown in FIG. 6B, the second refiner bars 26B', 36B' may comprise a longitudinal length $L_1$ of from about 0.6 cm to about 10 cm and preferably from about 2 cm to about 10 cm. The height of the second refiner bars 26B', 36B' may decrease continuously along substantially the entire longitudinal length $L_1$ from the second maximum height $H_2$ to a second minimum height $H_2'$. In another particular embodiment, the second refiner bars 26B', 36B' may extend substantially horizontally from the first radially outward position $P_2'$ to the second radially outward position $P_3'$, as depicted by the dashed line in FIG. 6B, such that the second refiner bars 26B', 36B' are at the second maximum height $H_2$ along substantially the entire longitudinal length $L_1$ of the second refiner bars 26B', 36B'. In a particular embodiment, the fourth refiner bars 26D, 36D may slope continuously downward from the third radially outward position $P_4$ to the fourth radially outward position $P_5$. As shown in FIG. 6B, the height of the fourth refiner bars 26D, 36D may decrease continuously along substantially the entire longitudinal length $L_2$ from the fourth maximum height $H_4$ to a fourth minimum height $H_4'$. In another particular embodiment, the fourth refiner bars 26D, 36D may extend substantially horizontally from the third radially outward position $P_4$ to the fourth radially outward position $P_5$, as depicted by the dashed line in FIG. 6B, such that the fourth refiner bars 26D, 36D are at the fourth maximum height $H_4$ along substantially the entire longitudinal length $L_2$ of the fourth refiner bars 26D, 36D. In other embodiments (not shown), the third refiner bars 26C, 36C may be radially separated from the fourth refiner bars 26D, 36D by a space.

With reference to FIGS. 4B, 5B, and 7, the refining surface 24, 34 may comprise dams 29, 39 provided in at least a portion of the first and/or third refiner grooves 28A', 38A', 28C, 38C, as described herein.

The first refiner bars 26A', 36A' in FIGS. 4B, 5B, and 6B are adapted to refine wood fibers, and the second refiner bars 26B', 36B' in FIGS. 4B, 5B, and 6B are adapted to break up fiber bundles, as described with respect to the first and second refiner bars 26A, 36A, 26B, 36B in FIGS. 4A, 5A, and 6A. The third refiner bars 26C, 36C are adapted to refine wood fibers (similar to the first refiner bars 26A', 36A'), while the fourth refiner bars 26D, 36D are adapted to break up fiber bundles (similar to the second refiner bars 26B', 36B'), as described herein.

With reference to FIGS. 1, 4B, 5B, and 6B, the portions of the refining space 60 that are at least partially defined by the first refiner grooves 28A', 38A' and the third refiner grooves 28C, 38C and extending from the radially inward position $P_1'$ to the first radially outward position $P_2'$ and from the second radially outward position $P_3'$ to the third radially outward position $P_4$ on the refining surface 24, 34 may at least partially define first and second refining zones, respectively, as described herein. The portions of the refining space 60 that are at least partially defined by the second refiner grooves 28B', 38B' and the fourth refiner grooves 28D, 38D and extending from the first radially outward position $P_2'$ to the second radially outward position $P_3'$ and from the third radially outward position $P_4$ to the fourth radially outward position $P_5$ on the refining surface 24, 34 may at least partially define first and second deflaking zones, respectively, as described herein. It is believed that the second maximum height $H_2$ of the second refiner bars 26B', 36B' should be at least about 0.35 mm less than the first maximum height $H_1$ of the first refiner bars 26A', 36A' in order to cease refining of the fibers and begin deflaking. Similarly, it is believed that the fourth maximum height $H_4$ of the fourth refiner bars 26D, 36D should be at least about 0.35 mm less than the third maximum height $H_3$ of the third refiner bars 26C, 36C in order to cease refining of the fibers and begin deflaking. The first and second refining zones may comprise 60% or more of the total area defined by both the first and second refining and deflaking zones on each refining surface 24, 34.

FIGS. 8 and 9 are partial cross-sectional views of the first and second refining bodies 22, 32/132 of the first and second refining members 20, 30/130 according to the present disclosure. The first refining member 20 is spaced apart and positioned adjacent to and across from the second refining member 30 (see FIG. 1). In the embodiment shown in FIG. 8, a refining body according to the present invention, e.g., the first refining body 22, is paired with the conventional refining body 132. The first refining body 22 comprises a first refiner bar 26A, a first refiner groove 28A, a second refiner bar 26B, and a second refiner groove 28B, which may correspond to the first and second refiner bars 26A, 26B and first and second refiner grooves 28A, 28B, as described herein with respect to FIGS. 4A, 4B, 6A, 6B, and 7. It is understood that the features described in FIG. 8 with respect to the first and second refiner bars 26A, 26B and first and second refiner grooves 28A, 28B apply equally to the third and fourth refiner bars 26C, 26D and third and fourth refiner grooves 28C, 28D, respectively, as described herein (see FIGS. 4B, 5B, and 6B). The conventional refining body 132 comprises a conventional refiner bar 136, which is a uniform height along substantially the entire longitudinal length of the refiner bar 136, and a refiner groove 138. In other embodiments (not shown), the non-rotating stator member, e.g., the first refining member 20, may comprise conventional refiner bars that are a uniform height along substantially their entire length, and the rotating rotor member, e.g., the second refining member 30 may comprise refiner bars 26A, 26B and refiner grooves 28A, 28B according to the present disclosure (see FIG. 1).

A first gap $G_1$ is defined in FIG. 8 between an outer surface S26A of the first refiner bar 26A and an outer surface S136 of the conventional refiner bar 136. In examples in which the second refiner bar 26B slopes continuously downward, a second gap $G_2$ may be defined between an outer surface S26B of the second refiner bar 26B and the outer surface of the conventional refiner bar 136, in which $G_2$ is greater than $G_1$. In examples in which the second refiner bar 26B extends substantially horizontally (shown in FIG. 8 by dashed lines), a third gap $G_3$ may be defined between an outer surface S26B' of the second refiner bar 26B and the outer surface S136 of the conventional refiner bar 136, in which $G_3$ is greater than $G_1$. As shown in FIG. 8, in embodiments in which one of the second refiner bars, e.g., the second refiner bar 26B, is sloped, a distance between the outer surface S26B of the second refiner bar 26B and the outer surface S136 of the conventional refiner bar 136 may increase continuously along at least a portion of the longitudinal length (not labeled; see FIGS. 6A and 6B) of the second refiner bar 26B from a minimum distance corresponding to the third gap $G_3$ to a maximum distance corresponding to the second gap $G_2$.

In the embodiment shown in FIG. 9, one refining body according to the present invention, e.g., the first refining body 22, is paired with another refining body according to the present invention, e.g., the second refining body 32. The first refining body 22 comprises a first refiner bar 26A, a first refiner groove 28A, a second refiner bar 26B, and a second refiner groove 28B, which may correspond to the first and second refiner bars 26A, 26B and first and second refiner grooves 28A, 28B, as described herein with respect to FIGS. 4A, 4B, 6A, 6B, and 7. The second refining body 32 comprises a first refiner bar 36A, a first refiner groove 38A, a second refiner bar 36B, and a second refiner groove 38B, which may correspond to the first and second refiner bars 36A, 36B and first and second refiner grooves 38A, 38B, as described herein with respect to FIGS. 5A, 5B, 6A, 6B, and 7. It is understood that the features described in FIG. 9 with respect to the first and second refiner bars 26A, 26B, 36A, 36B and first and second refiner grooves 28A, 28B, 38A, 38B apply equally to the third and fourth refiner bars 26C, 26D and third and fourth refiner grooves 28C, 28D, respectively, as described herein (see FIGS. 4B, 5B, and 6B).

A first gap $G_1$ is defined between an outer surface S26A of the first refiner bar 26A of the first refining body 22 and an outer surface S36A of the first refiner bar 36A of the second refining body 32. In examples in which the second refiner bar 26B of the first refining body 22 and the second refiner bar 36B of the second refining body 32 both slope continuously downward, a gap $G_4$ may be defined between an outer surface S26B of the second refiner bar 26B and an outer surface S36B of the second refiner bar 36B of the second refining body 32, in which $G_4$ is greater than $G_1$. In examples in which one of the second refiner bars, e.g., the second refiner bar 26B of the first refining body 22, slopes continuously downward and the other of the second refiner bars, e.g., the second refiner bar 36B of the second refining body 32, extends substantially horizontally (shown in FIG. 9 by dashed lines), a gap $G_5$ may be defined between the outer surface S26B of the second refiner bar 26B and an outer surface S36B' of the second refiner bar 36B, in which $G_5$ is greater than $G_1$. In examples in which the second refiner bar 26B of the first refining body 22 and the second refiner bar 36B of the second refining body 32 both extend substantially horizontally (shown in FIG. 9 with dashed lines), a gap $G_6$ may be defined between an outer surface S26B' of the second refiner bar 26B and the outer surface S36B' of the second refiner bar 36B, in which $G_6$ is greater than $G_1$. In some particular examples, $G_4$ is greater than $G_5$, and $G_5$ is greater than $G_6$.

As shown in FIG. 9, in embodiments in which one or both of the second refiner bars 26B, 36B are sloped, a distance between the outer surfaces S26B, S26B', 536B, S36B' of the second refiner bars 26B, 36B may increase continuously along at least a portion of the longitudinal length (not labeled; see FIGS. 6A and 6B) of one or both of the respective second refiner bars 26B, 36B. For example, when one refining body, e.g., the first refining body 22, comprises a sloped second refiner bar 26B, the distance between the outer surfaces S26B, S36B' of the second refiner bars 26B, 36B may increase from a minimum distance corresponding to the gap $G_6$ to a maximum distance corresponding to the third gap $G_5$. When both refining bodies 22, 32 comprise sloped second refiner bars 26B, 36B, the distance between the outer surfaces S26B, S36B of the second refiner bars 26B, 36B may increase from a minimum distance corresponding to the gap $G_6$ to a maximum distance corresponding to the second gap $G_4$.

In all embodiments depicted in FIGS. 8 and 9, as the rotatable refining member (e.g., the first refining member 20; see FIG. 1) rotates relative to the stationary refining member (e.g., the second refining member 30/130; see FIG. 1), the pulp slurry comprising wood fibers is supplied to the frame 66, e.g., the inlet 16, of the refiner 10 (see FIG. 1) and enters the refining space 60 defined between the first and second refining bodies 22, 32/132. With reference to FIG. 8, as the wood fibers enter the portion of the refining space 60 that is at least partially defined by the first refiner grooves 28A of the first refining body 22 and the refiner grooves 138 of the second refining body 132, the first and second refining bodies 22, 132 are spaced apart to define the first gap $G_1$ between the first refiner bars 26A of the first refining body 22 and the conventional refiner bars 136 of the second refining body 132 such that the refiner bars 26A and 136 interact with one another to refine the wood fibers, as described herein. It is believed that the first gap $G_1$ should be less than about 0.9 mm and preferably between about 0.2 mm to about 0.9 mm in order for refining to occur.

With continued reference to FIG. 8, as the wood fibers pass into the portion of the refining space 60 that is at least partially defined by the second refiner grooves 28B of the first refining body 22 and the refiner grooves 138 of the second refining body 132, a distance between the second refiner bars 26B of the first refining body 22 and the refiner bars 136 of the second refining body 132 is increased such that it is believed that refining stops and deflaking begins. In embodiments in which the second refiner bars 26B slope continuously downward, the distance increases from the first gap $G_1$ to the second gap $G_2$. In embodiments in which the second refiner bars 26B extend substantially horizontally, the distance increases from the first gap $G_1$ to the third gap $G_3$. It is believed that the distance between the second refiner bars 26B of the first refining body 22 and the refiner bars 136 of the second refining body 132, i.e., $G_2$ or $G_3$, should be between about 0.9 mm and about 1.5 mm in order for deflaking to occur.

With reference to FIG. 9, as the wood fibers enter the portion of the refining space 60 that is at least partially defined by the first refiner grooves 28A, 38A of the first and second refining bodies 22, 32, respectively, the first and second refining bodies 22, 32 are spaced apart to define the first gap $G_1$ between the first refiner bars 26A, 36A such that the refiner bars 26A, 36A interact with one another to refine the wood fibers, as described herein. As the wood fibers pass into the portion of the refining space 60 that is at least partially defined by the second refiner grooves 28B, 38B of the first and second refining bodies 22, 32, respectively, a distance between the second refiner bars 26B of the first refining body 22 and the second refiner bars 36B of the second refining body 32 increases to one of the gaps $G_4$, $G_5$, or $G_6$ such that refining stops and deflaking begins. It is believed that the first gap $G_1$ should be less than about 0.9 mm and preferably between about 0.2 mm to about 0.9 mm in order for refining to occur and that the gaps $G_4$, $G_5$, $G_6$ should be between about 0.9 mm and about 1.5 mm in order for deflaking to occur.

With reference to FIGS. 1, 6A, 6B, 8, and 9, the gaps $G_1$ and $G_2$, $G_3$, $G_4$, $G_4$, $G_5$, $G_6$ defined between the refining bodies 22, 32/132 may be adjusted by applying axial pressure to at least one of the first or second refining members 20, 30, for example, via the second motor 76 that is coupled to the movable support frame 68 via the jack screw (not shown). For a single-disc refiner, the second refining member 30 may be coupled directly to the movable support frame 68 such that the second refining member 30 moves with the movable support frame 68 as the latter is moved via the second motor 76 and the jack screw. For a double-disc refiner 10, the second refining member 30 is moved as described above, i.e., as the jack screw rotates in a first direction, it causes movement of the movable support frame 68 and the fourth refining member 50 inwardly towards the third refining member 40. The fourth refining member 50 then applies an axial force to the wood slurry passing through the second refining space 62 which, in turn, applies an axial force to the third refining member 40, causing the third refining member 40, the support 70 and the second refining member 30 to move inwardly toward the first refining member 20.

The gap $G_1$ defined between the refiner bars 26A, 36A, 136 may be maintained at a substantially constant gap value by adjusting the positioning of the second refining member 30 relative to the first refining member 20 via the second motor 76 (controlled manually or via a controller/processor coupled to the second motor 76) and jack screw so that an amount of power required to be input/generated by the first motor 74 (controlled manually or via a controller/processor coupled to the first motor 74), running at a predetermined rotational velocity, to process a certain amount of pulp flowing through the refining space 60, is maintained at a predefined input power level, which power level is monitored by an operator or a controller/processor controlling the first motor 74. For example, if pulp is moving through the refining space 60 of a 20 inch diameter Andritz® Twinflo IIIB low consistency refiner at a flow rate of 151 gallons/minute, and the first motor 74 is running at a constant rotational speed of 800 RPM, the second motor 76 is controlled so as to move the second refining member 30 relative to the first refining member 20 until the power input by the first motor 74 equals 114 kilowatts. When the power input by the first motor 74 equals 114 kilowatts, it is presumed that the gap size between the first and second refining members 20, 30 is at a value of 0.57 mm.

With continued reference to FIGS. 1, 6A, 6B, 8, and 9, it is believed that the gap $G_2$, $G_3$, $G_4$, $G_4$, $G_5$, $G_6$ required to achieve deflaking may vary depending on the load or flow rate (i.e., the liters/minute of pulp slurry flowing through the refining space 60) to which the refining bodies 22, 32/132 are subjected. For example, when the refining bodies 22, 32/132 are lightly loaded, refining of the wood fibers may stop and deflaking may begin almost immediately upon passage of the fibers into the portion of the refining space 60 that is at least partially defined by the second refiner grooves 28B/28B', 38B/38B', e.g., upon movement of the wood fibers past the first radially outward position $P_2/P_2'$ and/or the third radially outward position $P_4$, as shown in FIGS. 6A and 6B. When the refining bodies 22, 32/132 are heavily loaded, some refining of the wood fibers may continue along at least a portion of the refining space 60 that is at least partially defined by the second refiner grooves 28B/28B', 38B/38B'.

In situations in which the refining bodies 22, 32/132 are heavily loaded, embodiments in which one or both of the second refiner bars 26B/26B' of the first refining body 22 and the second refiner bars 36B/36B' of the second refining body 32 slope continuously downward may be particularly advantageous to ensure that a sufficient distance between the refiner bars 26B/26B' and 136/36B/36B' is achieved along at least a portion of the refining space 60 that is at least partially defined by the second refiner grooves 28B/28B', 38B/38B' to allow refining to cease and deflaking to occur. In addition, the refining surfaces 24, 34 of the refining bodies 22, 32 may wear and degrade over time. In particular, the first and third refiner bars 26A/26A', 26C, 36A/36A', 36C that perform the majority of the high intensity, high energy refining may wear faster than the second and fourth refiner bars 26B/26B', 26D, 36B/36B', 36D that perform deflaking, which is generally lower intensity and lower energy than refining. The position of the refining bodies 22, 32/132 may be adjusted as described herein to maintain the first gap $G_1$ between the first and third refiner bars 26A/26A', 26C, 36A/36A', 36C at a substantially constant value as their outer surfaces S26A, S36A begin to wear down. However, the gap $G_2$, $G_3$, $G_4$, $G_4$, $G_5$, $G_6$ between the second and fourth refiner bars 26B/26B', 26D, 36B/36B', 36D may not be adjustable. Thus, embodiments in which one or both of the second refiner bars 26B/26B', 36B/36B' and/or one or both of the four refiner bars 36B/36B', 36D are sloped are believed to allow the transition between the refining and deflaking zones to shift radially outward along the longitudinal length (not labeled; see FIGS. 6A and 6B) of the second and fourth refiner bars 26B/26B', 26D, 36B/36B', 36D as the first and third refiner bars 26A/26A', 26C, 36A/36A', 36C wear down.

Figure 10:
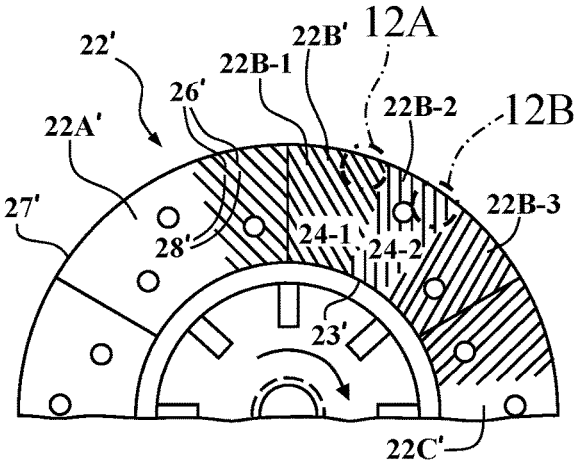
FIGS. 10 and 11 are plan views of portions of a first and a second refining body, respectively, comprising a plurality of radially extending pie-shaped segments.
Figure 11:
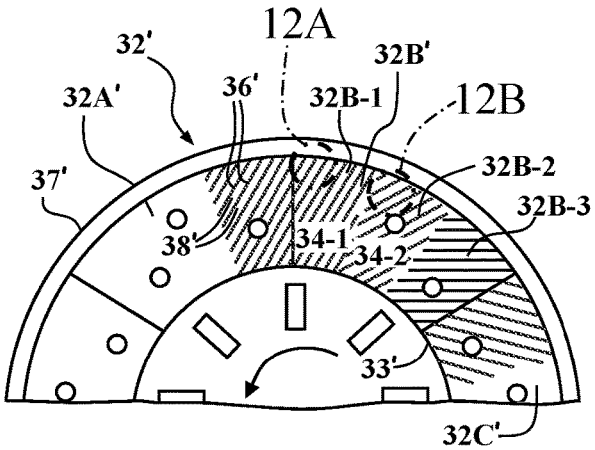

FIGS. 10 and 11 are plan views of portions of refining surfaces of a first refining body 22' and a second refining body 32', respectively, according to another embodiment of the present disclosure. With reference to FIGS. 1, 10, and 11, the first and second refining bodies 22', 32' may be part of refining members, e.g., first and second refining members 20, 30, respectively, as described herein, for use in a pulp refiner, such as the disc refiner 10 depicted in FIG. 1. Each of the refining members 20, 30 comprising the first and second refining bodies 22', 32', respectively, may be associated with the main support frame comprising the fixed support frame 66 secured to the first housing section 12 and the movable support frame 68. One refining member, e.g., the first refining member 20 comprising the first refining body 22', may be fixed to the support frame 66 of the refiner 10 to define a non-rotating stator member. Another refining member, e.g., a second refining member 30 comprising the second refining body 32', may be fixed to the support 70, which rotates with the shaft 72 and defines a rotor that is associated with the main support frame, such that rotation of the rotor effects movement of the second refining member 30 relative to the first refining member 20. Third and fourth refining members (not shown), having third and fourth refining bodies similar to the first and second refining bodies 22', 32', may also be provided.

As shown in FIG. 10, the first refining body 22' comprises a plurality of sections 22A'-22C' that may be bolted or otherwise attached together to form the disc-shaped refining body 22' comprising a radially outer edge 27'. Each section 22A'-22C' comprises a plurality of elongated refiner bars 26' separated from one another by refiner grooves 28'. Although not shown in FIG. 10, it is understood that the other sections (not labeled) of the first refining body 22' would similarly comprise refiner bars 26' and refiner grooves 28'. The refiner bars 26' extend radially outwardly from a radially inner location 23' toward the radially outer edge 27' of the first refining body 22'. Each section 22A'-22C' of the first refining body 22' may comprise one or more or more radially extending pie-shaped segments comprising at least one first pie-shaped segment 22B-1 and at least one second pie-shaped segment 22B-2.

As shown in FIG. 11, the second refining body 32' comprises a corresponding plurality of sections 32A'-32C' that may be bolted or otherwise attached together to form the disc-shaped refining body 32' comprising a radially outer edge 37'. Each section 32A'-32C' comprises a plurality of elongated refiner bars 36' separated from one another by refiner grooves 38'. Although not shown in FIG. 11, it is understood that the other sections (not labeled) of the second refining body 32' would similarly comprise refiner bars 36' and refiner grooves 38'. The refiner bars 36' extend radially outwardly from a radially inner location 33' toward the radially outer edge 37' of the second refining body 32'. Each section 32A'-32C' of the second refining body 32' may comprise one or more or more radially extending pie-shaped segments comprising at least one first pie-shaped segment 32B-1 and at least one second pie-shaped segment 32B-2. Although not discussed in detail herein, the third and fourth refining bodies 42, 52 of FIG. 1 may comprise a structure that is substantially similar to the first and second refining bodies 22', 32', respectively, as described herein.

Figure 12A:
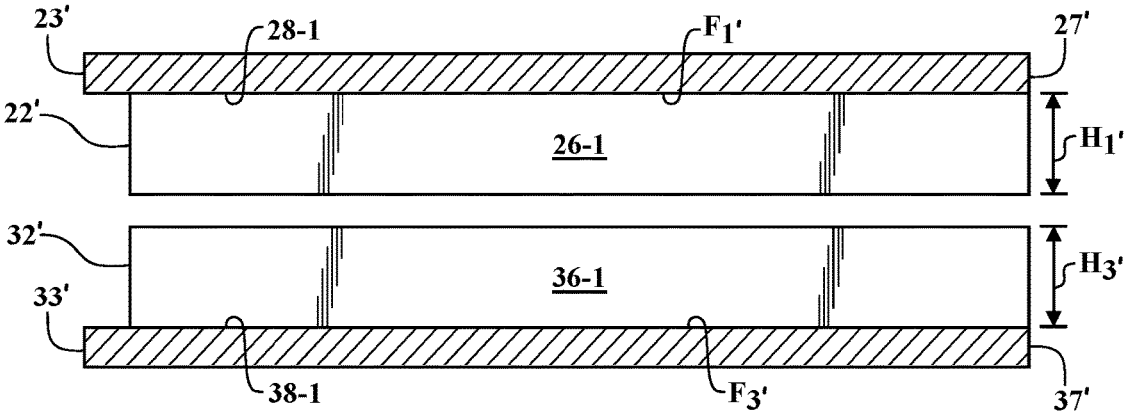
FIGS. 12A and 12B are partial cross-sectional views of refiner bars from the pie-shaped segments of FIGS. 10 and 11, in which one refining body is spaced apart and positioned above another refining body.
Figure 12B:
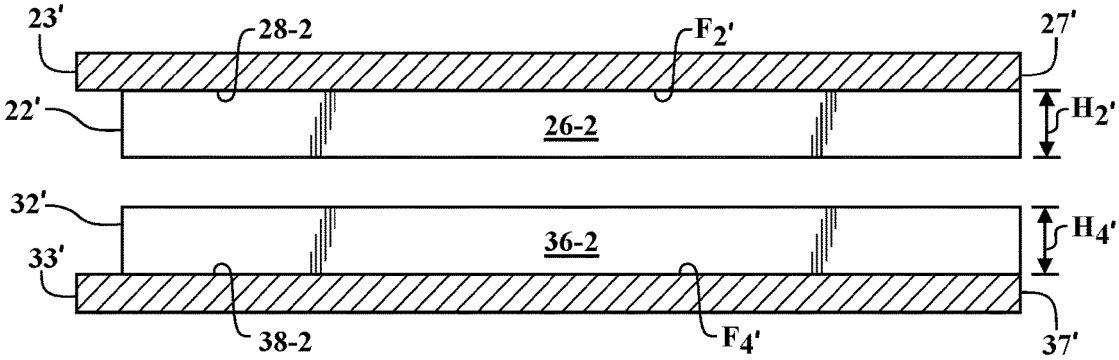

At least one of the first and second refining bodies 22', 32' of FIGS. 10 and 11 comprises one or more sections 22A'-22C', 32A'-32C' with at least one radially extending pie-shaped segment, e.g., 22B-1 and 32B-1, of refiner bars 26', 36' that comprises one or more characteristics that are different from the refiner bars 26', 36' in an adjacent radially extending pie-shaped segment, e.g., 22B-2 and 32B-2, respectively. FIGS. 12A and 12B are partial cross-sectional views in which the first and second refining bodies 22', 32' of FIGS. 10 and 11 are spaced apart and positioned adjacent to and across from each other (see FIG. 1). In FIG. 12A, a first refiner bar 26-1, which may be located on a refining surface 24-1 of the at least one first pie-shaped segment 22B-1 of the first refining body 22' (also referred to herein as a first refining surface), is spaced apart and positioned adjacent to and across from a third refiner bar 36-1, which may be located on a refining surface 34-1 of the at least one third pie-shaped segment 32B-1 of the second refining body 32' (also referred to herein as a third refining surface). In FIG. 12B, a second refiner bar 26-2, which may be located on a refining surface 24-2 of the at least one second pie-shaped segment 22B-2 of the first refining body 22' (also referred to herein as a second refining surface), is spaced apart and positioned adjacent to and across from a fourth refiner bar 36-2, which may be located on a refining surface 34-2 of the at least one fourth pie-shaped segment 32B-2 of the second refining body 32' (also referred to herein as a fourth refining surface).

With reference to FIGS. 10, 11, and 12A, the first refiner bars 26-1 are separated from one another by first refiner grooves 28-1 and may comprise a first maximum height $H_1'$ extending upward from a floor $F_1'$ of a respective adjacent first refiner groove 28-1. The third refiner bars 36-1 are separated from one another by third refiner grooves 38-1 and may comprise a third maximum height $H_3'$ extending upward from a floor $F_3'$ of a respective adjacent third refiner groove 38-1. As shown in FIG. 12A, the first and third refiner bars 26-1, 36-1 may be substantially similar to one another, and the first and third maximum heights $H_1'$, $H_3'$ may be substantially equal. With reference to FIGS. 10, 11, and 12B, the second refiner bars 26-2 are separated from one another by second refiner grooves 28-2 and may comprise a second maximum height $H_2'$ extending upward from a floor $F_2'$ of an adjacent second refiner groove 28-2. The fourth refiner bars 36-2 are separated from one another by fourth refiner grooves 38-2 and may comprise a fourth maximum height $H_4'$ extending upward from a floor $F_4'$ of an adjacent fourth refiner groove 38-2. As shown in FIG. 12B, the second and fourth refiner bars 26-2, 36-2 may be substantially similar to one another, and the second and fourth maximum heights $H_2'$, $H_4'$ may be substantially equal. All of the refiner bars 26-1, 26-2, 36-1, 36-2 within a respective pie-shaped segment 22B-1, 22B-2, 32B-1, 32B-2 may comprise a same height with respect to each other.

The second maximum height $H_2'$ of the second refiner bars 26-2 may be less than the first maximum height $H_1'$ of the first refiner bars 26-1. In some examples, the second maximum height $H_2'$, when measured from the floor $F_2'$ of the adjacent second refiner groove 28-2, may be at least 0.35 mm less than the first maximum height $H_1'$. In other examples, the second maximum height $H_2'$, when measured from the floor $F_2'$ of the adjacent second refiner groove 28-2, may be at least 0.70 mm less than the first maximum height $H_1'$. In further examples, the first maximum height $H_1'$ of the first refiner bars 26-1, when measured from the floor $F_1'$ of the respective adjacent first refiner groove 28-1, may be from about 4 mm to about 10 mm. In a particular example, the second maximum height $H_2'$ of the second refiner bars 26-2, when measured from the floor $F_2'$ of the respective adjacent second refiner groove 28-2, may be from about 0.35 mm to about 1.5 mm less than the first maximum height $H_1'$. In another particular example, the second maximum height $H_2'$ of the second refiner bars 26-2, when measured from the floor $F_2'$ of the respective adjacent second refiner groove 28-2, may be from about 0.7 mm to about 1.5 mm less than the first maximum height $H_1'$. In further examples, the first refiner bars 26-1 and the second refiner bars 26-2 may comprise a width extending between sides edges of the respective refiner bars 26-1, 26-2 of from about 2 mm to about 8 mm (not shown; see FIG. 7). The fourth maximum height $H_4'$ of the fourth refiner bars 36-2, which may correspond to the second maximum height $H_2'$, may be less than the third maximum height $H_3'$ of the third refiner bars 36-1, which may correspond to the first maximum height $H_1'$.

With reference to FIGS. 1, 10, 11, 12A, and 12B, as the second refining member 30 rotates relative to the first refining member 20, the refining surface 34-1 of the at least one third pie-shaped segment 32B-1 of the second refining body 32' will pass the refining surface 24-1 of the at least one first pie-shaped segment 22B-1 of the first refining body 22', and the refining surface 34-2 of the at least one fourth pie-shaped segment 32B-2 of the second refining body 32' will pass the refining surface 24-2 of the at least one second pie-shaped segment 22B-2 of the first refining body 22'. When a slurry of wood pulp is supplied to the frame 66, e.g., the inlet 16, of the refiner 10 and passes through the refining space 60, and the refining surface 34-1 of the at least one third pie-shaped segment 32B-1 of the second refining body 32' passes the refining surface 24-1 of the at least one first pie-shaped segment 22B-1 of the first refining body 22', the third refiner bars 36-1 comprising the third maximum height $H_3'$ will be positioned opposite the first refiner bars 26-1 comprising the first maximum height $H_1'$ such that the first and third refiner bars 26-1 and 36-1 refine a significant number of the wood fibers. When the refining surface 34-2 of the at least one fourth pie-shaped segment 32B-2 of the second refining body 32' passes the refining surface 24-2 of the at least one second pie-shaped segment 22B-2 of the first refining body 22', the fourth refiner bars 36-2 comprising the fourth maximum height $H_4'$ will be positioned opposite from the second refiner bars 26-2 comprising the second maximum height $H_2'$ such that the second and fourth refiner bars 26-2 and 36-2 break up or separate a plurality of wood fiber bundles in the wood pulp slurry, as described herein. Low intensity refining may occur when the refining surface 34-1 of the at least one third pie-shaped segment 32B-1 of the second refining body 32' passes the refining surface 24-2 of the at least one second pie-shaped segment 22B-2 of the first refining body 22', and the refining surface 34-2 of the at least one fourth pie-shaped segment 32B-2 of the second refining body 32' passes the refining surface 24-1 of the at least one first pie-shaped segment 22B-1 of the first refining body 22'.

As shown in FIGS. 10 and 11, one or more of the sections 22A'-22C', 32A'-32C' of the respective refining bodies 22', 32' may, in some examples, each comprise three radially extending pie-shaped segments 22B-1, 22B-1, 22B-3 and 32B-1, 32B-2, 32B-3. In some particular examples, two segments, e.g., 22B-1, 22B-3 and 32B-1, 32B-3, may comprise refiner bars with one of the first or second maximum height $H_1'$, $H_2'$, and one segment, e.g., 22B-2 and 32B-2, may comprise refiner bars with the other of the first or second maximum height $H_1'$, $H_2'$, in which the second maximum height $H_2'$ is less than the first maximum height $H_1'$. For example, the segments 22B-1, 22B-3 may comprise the first refiner bars 26-1, the segments 32B-1, 32B-3 may comprise third refiner bars 36-1, the segment 22B-2 may comprise the second refiner bars 26-2, and the segment 32B-2 may comprise the fourth refiner bars 36-2. In other examples (not shown), one or more of the sections 22A'-22C', 32A'-32C' may each comprise only two segments of refiner bars or may each comprise four or more segments of refiner bars. In further examples (not shown), one or more of the sections 22A'-22C', 32A'-32C' may not comprise separate segments, such that an entire section comprises refiner bars of one height. It is understood that a refining body according to the present disclosure, e.g., one of refining bodies 22', 32', may be paired with a refining body comprising conventional refiner bars, e.g., refiner bars that are all of the same height.

It is believed that a gap between opposing first and third refiner bars 26-1, 36-1 should be less than about 0.9 mm and preferably between about 0.2 mm to about 0.9 mm in order for refining to occur and that a gap between opposing second and fourth refiner bars 26-2, 36-2 should be between about 0.9 mm and about 1.5 mm in order for deflaking to occur.

FIGS. 13 and 14 are plan views of portions of a first refining surface 224 of a first refining body 222 and a second refining surface 234 of a second refining body 232, respectively, according to another embodiment of the present disclosure. With reference to FIGS. 1, 13, and 14, the first and second refining bodies 222, 232 may be part of refining members, e.g., refining members 20, 30, respectively, as described herein, for use in a pulp refiner, such as the disc refiner 10 depicted in FIG. 1. Each of the refining members 20, 30 comprising the first and second refining bodies 222, 232, respectively, may be associated with the main support frame comprising the fixed support frame 66 secured to the first housing section 12 and the movable support frame 68. One refining member, e.g., the first refining member 20 comprising the first refining body 222, may be fixed to the support frame 66 of the refiner 10 to define a non-rotating stator member. Another refining member, e.g., the second refining member 30 comprising the second refining body 232, may be fixed to the support 70, which rotates with the shaft 72 and defines a rotor that is associated with the main support frame, such that rotation of the rotor effects movement of the second refining member 30 relative to the first refining member 20.

As shown in FIG. 13, the first refining body 222 comprises a plurality of sections (not separately labeled; see FIGS. 2 and 3) that may be bolted or otherwise attached together to form the disc-shaped refining body 222 comprising a radially outer edge 227. The first refining surface 224 comprises a plurality of elongated first refiner bars 226 separated from one another by first refiner grooves 228. The first refiner bars 226 extend radially outwardly from a radially inner location 223 toward the radially outer edge 227 of the first refining body 222. The first refiner bars 226 may be slanted at various angles as shown in FIG. 13, and each section of the refining body 222 may comprise one or more segments (not labeled) of refiner bars 226 that are slanted in different directions. The first refining body 222 further comprises one or more annular rows or rings of teeth 400 located between the first refiner bars 226 and the radially outer edge 227 of the first refining body 222. Although not shown in FIG. 13, it is understood that the other sections (not labeled) of the first refining body 222 would similarly comprise refiner bars 226, refiner grooves 228, and teeth 400.

As shown in FIG. 14, the second refining body 232 comprises a plurality of sections (not separately labeled; see FIGS. 2 and 3) that may be bolted or otherwise attached together to form the disc-shaped refining body 232 comprising a radially outer edge 237. The second refining surface 234 comprises a plurality of elongated second refiner bars 236 separated from one another by second refiner grooves 238. The second refiner bars 236 extend radially outwardly from a radially inner location 233 toward the radially outer edge 237 of the second refining body 232. The second refiner bars 236 may be slanted at various angles as shown in FIG. 14, and each section of the refining body 232 may comprise one or more segments (not labeled) of refiner bars 236 that are slanted in different directions. The second refining body 232 further comprises one or more annular rows or rings of teeth 400 located between the second refiner bars 236 and the radially outer edge 237 of the second refining body 232. Although not shown in FIG. 14, it is understood that the other sections (not labeled) of the second refining body 232 would similarly comprise refiner bars 236, refiner grooves 238, and teeth 400. In addition, although not discussed in detail herein, the structure of the refining surfaces 44, 54 of the third and fourth refining bodies 42, 52, respectively, of FIG. 1 may comprise a structure that is substantially similar to the refining surfaces 224, 234 of the first and second refining bodies 222, 232, respectively, as described herein.

Figure 16:
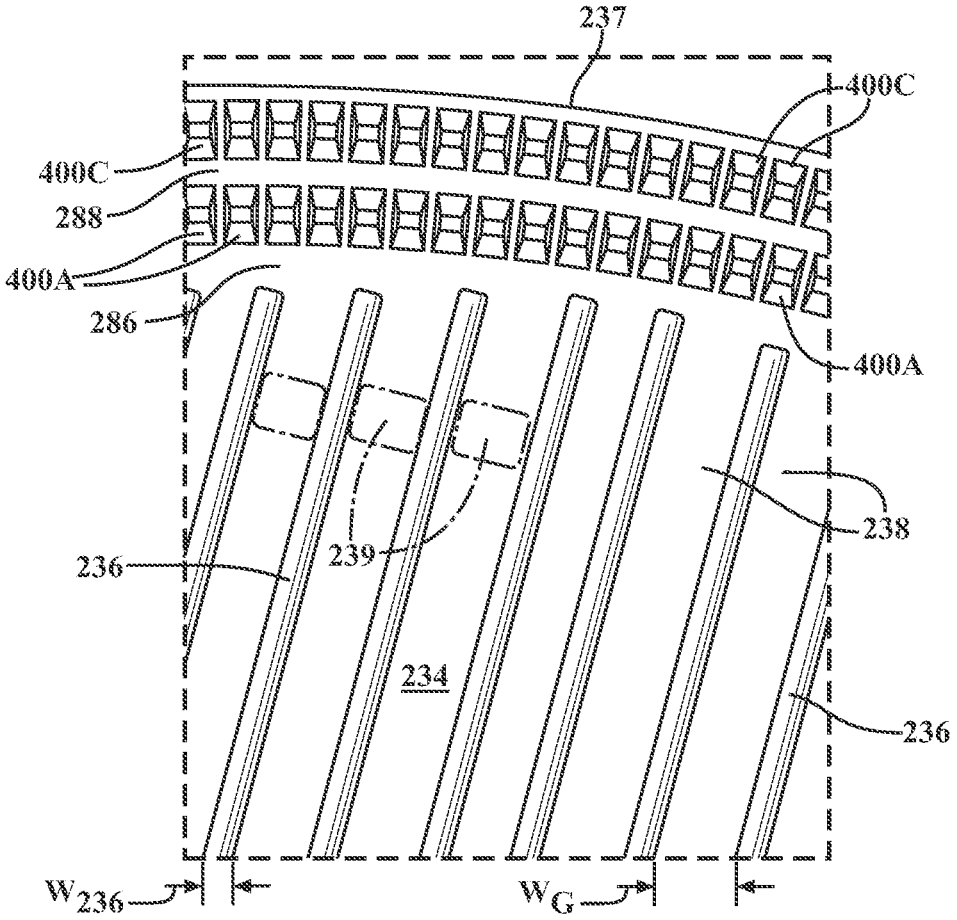
FIG. 16 is a plan view of a section of a refining surface of the second refining body of FIG. 14.
Figure 17:
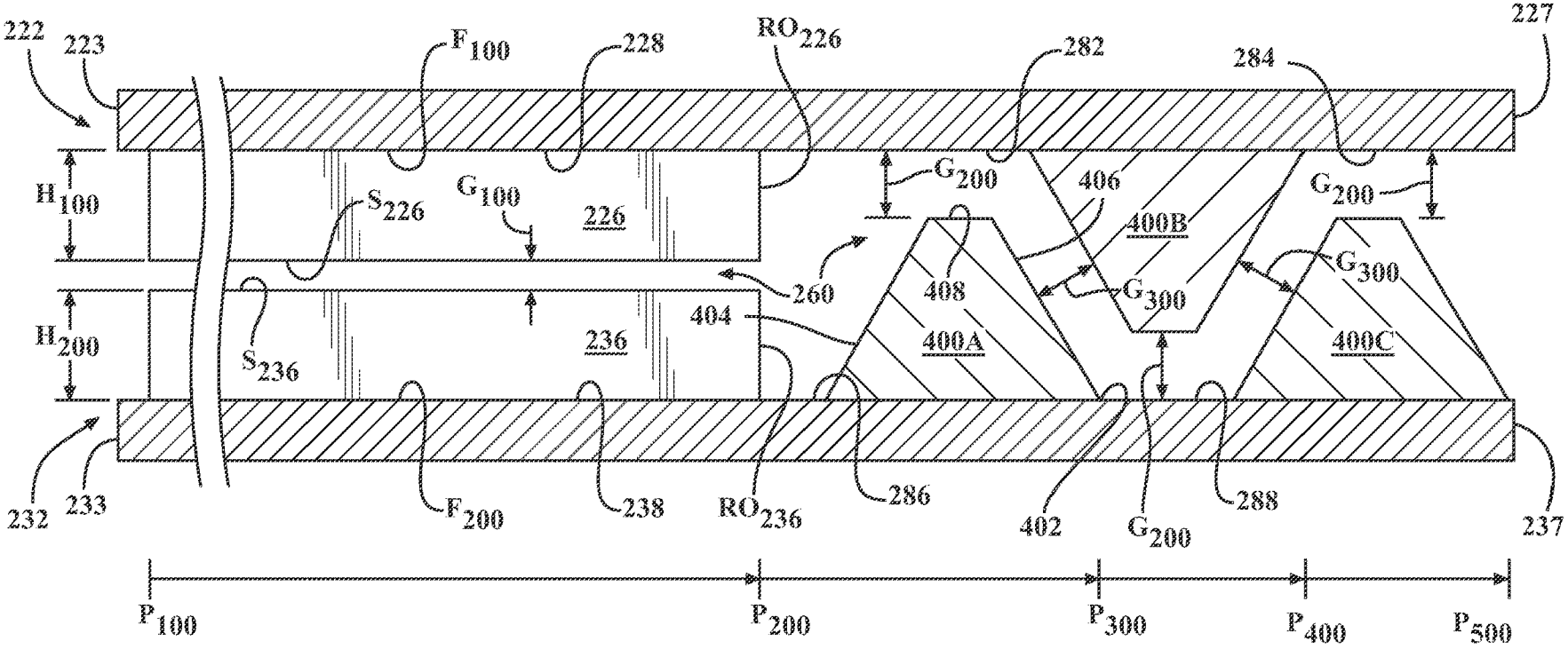
FIG. 17 is a partial cross-sectional view of a refiner bar and tooth on a first refining body that is spaced apart and positioned above a second refining body comprising a refiner bar and teeth.

FIGS. 15 and 16 are detailed views of one portion of the first and second refining surfaces 224, 234, of FIGS. 13 and 14, respectively. FIG. 17 is a partial cross-sectional view of a first refiner bar 226 and tooth 400B, which may be located on the first refining body 222 of FIGS. 13 and 15, and a second refiner bar 236 and teeth 400A, 400C, which may be located on the second refining body 232 of FIGS. 14 and 16, in which the first refining body 222 is spaced apart and positioned adjacent to and across from the second refining body 232 to define a refining space 260 therebetween. With reference to FIGS. 15-17, the first refining surface 224 comprises first refiner bars 226 that are separated from one another by first refiner grooves 228, and the second refining surface 234 comprises second refiner bars 236 that are separated from one another by second refiner grooves 238. One or both of the first and second refining surfaces 224, 234 may comprise dams 229, 239 provided in at least a portion of the first and second refiner grooves 228, 238, as described herein. Each of the first and second refiner bars 226, 236 extends from a radially inward position $P_{100}$ to a first radially outward position $P_{200}$ on the respective first and second refining surfaces 224, 234. In some examples, the radially inward position $P_{100}$ may comprise a position at or near the respective radially inner location 223, 233 (see FIGS. 13 and 14). The first and second refiner bars 226, 236 may comprise a width $W_{226}$, $W_{236}$, respectively, extending between sides edges of the respective refiner bars 226, 236 of from about 2 mm to about 8 mm. The first refining surface 224 comprises first teeth 400B located between a radially outer edge $RO_{226}$ of the first refiner bars 226 and the radially outer edge 227 of the first refining body 222. The first teeth 400B extend to a third radially outward position, e.g., $P_{400}$, on the first refining surface 224, in which the third radially outward position $P_{400}$ is nearer to an outermost part, e.g., the radially outer edge 227, of the first refining body 222 than the first radially outward position $P_{200}$ of the first refining bars 226. The second refining surface 234 comprises second teeth 400A, 400C that are located between a radially outer edge $RO_{236}$ of the second refiner bars 236 and the radially outer edge 237 of the second refining body 232. The second teeth 400A, 400C extend to a second or a fourth radially outward position, e.g., $P_{300}$ or $P_{500}$, on the second refining surface 234, in which the second and fourth radially outward positions $P_{300}$, $P_{500}$ are nearer to an outermost part, e.g., the radially outer edge 237, of the second refining body 232 than the first radially outward position $P_{200}$ of the second refining bars 236.

With continued reference to FIGS. 15-17, the teeth 400A-400C may be arranged in concentric rings and may protrude substantially perpendicularly toward one another from the respective refining surfaces 224, 234. The ring comprising first teeth 400B is spaced apart from the radially outer edge $RO_{226}$ of the first refiner bars 226 by a first substantially planar area 282 and from the radially outer edge 227 of the refining body 222 by a second substantially planar area 284. The ring comprising second teeth 400A is spaced apart from the radially outer edge $RO_{236}$ of the second refiner bars 236 by a first substantially planar area 286 and from the ring comprising second teeth 400C by a second substantially planar area 288. In the embodiment shown in FIGS. 15-17, the first refining surface 224 of the first refining body 222 comprises one concentric row/ring of first teeth 400B, and the second refining surface 234 of the second refining body 232 comprises two concentric rows/rings of second teeth 400A, 400C, in which the first and second teeth 400A-400C are arranged on the respective refining surfaces 224, 234 such that the first teeth 400B intermesh with the second teeth 400A, 400C. In other embodiments (not shown), the first refining surface 224 may comprise two or more concentric rings of teeth, and the second refining surface 234 may comprise one concentric row of teeth or three or more concentric rings of teeth. In all embodiments, one of the refining bodies will comprise one fewer rings of teeth than the other refining body, and the teeth are arranged on each refining body such that the teeth from one refining body intermesh with the teeth of the other refining body, as is known in the art.

It is understood that the teeth 400A-400C may comprise any suitable shape and/or dimensions known in the art. As illustrated with respect to tooth 400A in FIG. 17, in some examples, each of the first and second teeth 400A-400C may comprise a substantially pyramidal or trapezoidal shape with a base 402, a radially inward facing surface 404, a radially outward facing surface 406, sides (not separately labeled) slightly angled inwardly toward a center axis (not labeled) of the tooth 400A, and a generally planar outer surface 408. The radially inward and outward facing surfaces 404, 406 of each tooth 400A-400C may slope from the base 402 towards its respective outer surface 408. The outer surface 408 of each tooth 400A-400C may be substantially parallel to a plane of the respective substantially planar area 282, 284, 288 that is opposite the tooth 400A-400C. In other examples (not shown), each of the first and second teeth 400A-400C may comprise a shape that is substantially triangular, rectangular, or any other suitable geometric shape. As shown in FIGS. 15-17, the base 402 of the teeth 400A-400C may comprise a radial dimension that is greater than a circumferential dimension, but in other embodiments (not shown), the base 402 may comprise a radial dimension that is less than a circumferential dimension. In some instances, at least a portion of the base 402 of teeth 400A-400C may comprise a longitudinal length (not labeled), i.e., in a radial direction, of at least 0.6 cm, and in some particular instances, the longitudinal length may comprise between 0.6 cm to about 2 cm. In other instances, at least a portion of the base 402 of the teeth 400A-400C may comprise a width (not labeled), in a circumferential direction, that is substantially equal to the combined width, e.g., $W_{226}$, $W_{236}$, of one refiner bar 226, 236 and a width $W_G$ of one adjacent groove 228, 238. The width $W_G$ may be from about 2 mm to about 6 mm. For example, the base 402 of the teeth 400A-400C may comprise at least about 10 mm in the circumferential direction. In other instances, the base 402 of the teeth 400A-400C may comprise between about 10 mm and 20 mm in the circumferential direction. In addition, one or more of the radially inward and outward facing surfaces 404, 406 or the sides of one or more of the teeth 400A-400C may comprise one or more radially-extending projections that may affect the interaction of the teeth 400A-400C with the wood fibers to separate wood fiber bundles. The teeth 400A-400C may have a structure similar to those illustrated in U.S. Pat. No. 8,342,437 B2, the disclosure of which is incorporated herein by reference.

As shown in FIG. 17, the first refiner bars 226 comprise a first height $H_{100}$ extending upward from a floor $F_{100}$ of an adjacent first refiner groove 228, and the second refiner bars 236 comprise a second height $H_{200}$ extending upward from a floor $F_{200}$ of an adjacent second refiner groove 238. In some examples, the first and second heights $H_{100}$, $H_{200}$ of the first and second refiner bars 226, 236 may be substantially equal to one another and may comprise from about 4 mm to about 10 mm. The first and second refining bodies 222, 232 are spaced apart by a first gap $G_{100}$ that is defined between an outer surface S226 of the first refiner bar 226 and an outer surface S236 of the second refiner bar 236. A second gap $H_{200}$ is defined between the generally planar outer surfaces 408 of the teeth 400A-400C and a respective one of the substantially planar areas 282, 284, 288 that is opposite the tooth 400A-400C, in which $H_{200}$ may be greater than $G_{100}$. In some examples, a height (not labeled) of the teeth 400A-400C extending upward from the adjacent, respective first or second refiner groove 228, 238 may be about 8-10 mm. As shown in FIG. 17, the teeth 400A-400C are intermeshed such that a portion of one or both of the radially inward or outward facing surfaces 404, 406 of each tooth 400A-400C overlaps in an axial direction, e.g., in the direction of arrow A in FIG. 1, with a portion of the radially inward or outward facing surface 404, 406 of an adjacent tooth 400A-400C. The overlapping portion(s) of the teeth 400A-400C may be spaced apart by a third gap $G_{300}$ that is defined between the respective radially inward or outward facing surfaces 404, 406 of the teeth 400A-400C. In some examples, $G_{300}$ may be substantially equal to $G_{200}$. In other examples, $G_{300}$ may be less than or more than $G_{200}$.

With reference to FIGS. 1 and 17, when a slurry of wood pulp is supplied to the frame of the refiner 10, e.g., the inlet 16, the wood fibers pass into the portion of the refining space 260 that is at least partially defined by the first and second refiner grooves 228, 238, e.g., from about the first radially inward position $P_{100}$ to about the first radially outward position $P_{200}$. The first and second refiner bars 226, 236 interact with one another to refine a significant number of the wood fibers in the wood pulp, as described herein. It is believed that the first gap $G_{100}$ should be less than about 0.9 mm and preferably between about 0.2 mm to about 0.9 mm in order for refining to occur. The refined wood fibers then pass into the portion of the refining space 260 that is at least partially defined by the respective first and second substantially planar areas 282, 284, 286, 288, e.g., from about the first radially outward position $P_{200}$ to about the fourth radially outward position $P_{500}$. It is believed that the second and third gaps $G_{200}$ and $G_{300}$ should be between about 0.9 mm and about 1.5 mm in order for deflaking to occur. The teeth 400A-400C are adapted to break up or separate a plurality of wood fiber bundles in the wood pulp slurry, as described herein. $G_{200}$ is greater than $G_{100}$ such that it is believed that refining stops and deflaking begins at about the first radially outward first position $P_{200}$.

With reference to FIGS. 1 and 15-17, the refining surfaces 224, 234 of the refining bodies 222, 232, particularly the outer surfaces S226, S123 of the first and second refiner bars 226, 236 and the outer surfaces 408 of the teeth 400A-400C, may wear and degrade over time. To compensate for this wear, the spacing between the first and second refining members 20, 30 comprising the first and second refining bodies 222, 232, respectively, may be readjusted as described herein such that the first gap $G_{100}$ remains substantially constant. This adjustment of the first and second refining bodies 222, 232 may cause the second gap $G_{200}$ to decrease, as the refiner bars 226, 236 perform the more intense function of refining and typically wear faster than the teeth 400A-400C. This difference in wear may be factored into the selection of the teeth 400A-400C (e.g., the type(s) of metal used for the teeth 400A-400C, the initial size of the second gap $G_{200}$, the shape of the teeth 400A-400C, etc.) such that an adequate second gap $G_{200}$ may be maintained to ensure that refining ceases and deflaking begins when the wood fibers enter the portion of the refining space 260 that is at least partially defined by the respective first and second substantially planar areas 282, 284, 286, 288. When the refining bodies 222, 232 are new, the third gap $G_{300}$ may be substantially equal to or greater than the second gap $G_{200}$. As the refining surfaces 224, 234 wear and the refining members 20, 30 are moved closer together, the third gap $G_{300}$ may decrease until the third gap $G_{300}$ is less than the second gap $G_{200}$.

In all embodiments described herein, the refiner 10 of FIG. 1 may be coupled to a controller (not shown) that receives data from a fiber analyzer (e.g., a Valmet® MAP Pulp Analyzer (Valmet Corp.)) regarding one or more fiber properties measured at one or more locations downstream of the refiner 10, such as a number, size, etc. of fiber bundles (also referred to as "Wide Shives"), fibrillation, Canadian Standard Freeness, fiber length, fiber width, kink, curl, coarseness, number of fines, etc. Based on this data, the controller may control operation of the refiner 10 as part of a feedback loop. For example, the controller may adjust the spacing between the one or more pairs of refining members 20, 30, 40, 50 in order to maintain the one or more fiber properties within a predetermined target range. In some examples, it is believed that the controller may also increase or decrease a rotational speed of the one or more rotating rotor members of the refiner 10 (e.g., the second and third refining members 30, 40) based on this data. In other examples, the controller may control operation of the refiner 10, such as by varying the size of the refining gap $G_1$, $G_{100}$, and the deflaking gap $G_2$, $G_3$, $G_4$, $G_5$, $G_6$, $G_{200}$, $G_{300}$, to generate a refined softwood pulp that has less than a predetermined number, e.g., 1,000 ppm, of fiber bundles of a particular size, e.g., about 150-2,000 microns wide and from 0.3 to 40 mm long.

In other examples, refining members 20, 30, 40, 50 according to the present disclosure may be installed in one or more of a plurality of refiners that are arranged in a series, in which each refiner may be substantially similar to the refiner 10 of FIG. 1. The controller may control operation of one or more of the plurality of refiners in order to maintain the one or more fiber properties within the predetermined target range. In some particular examples, refining members 20, 30, 40, 50 according to the present disclosure may be installed only in the last refiner of the series, and in other examples, refining members 20, 30, 40, 50 according to the present disclosure may be installed in two or more of the refiners.

Figure 18:
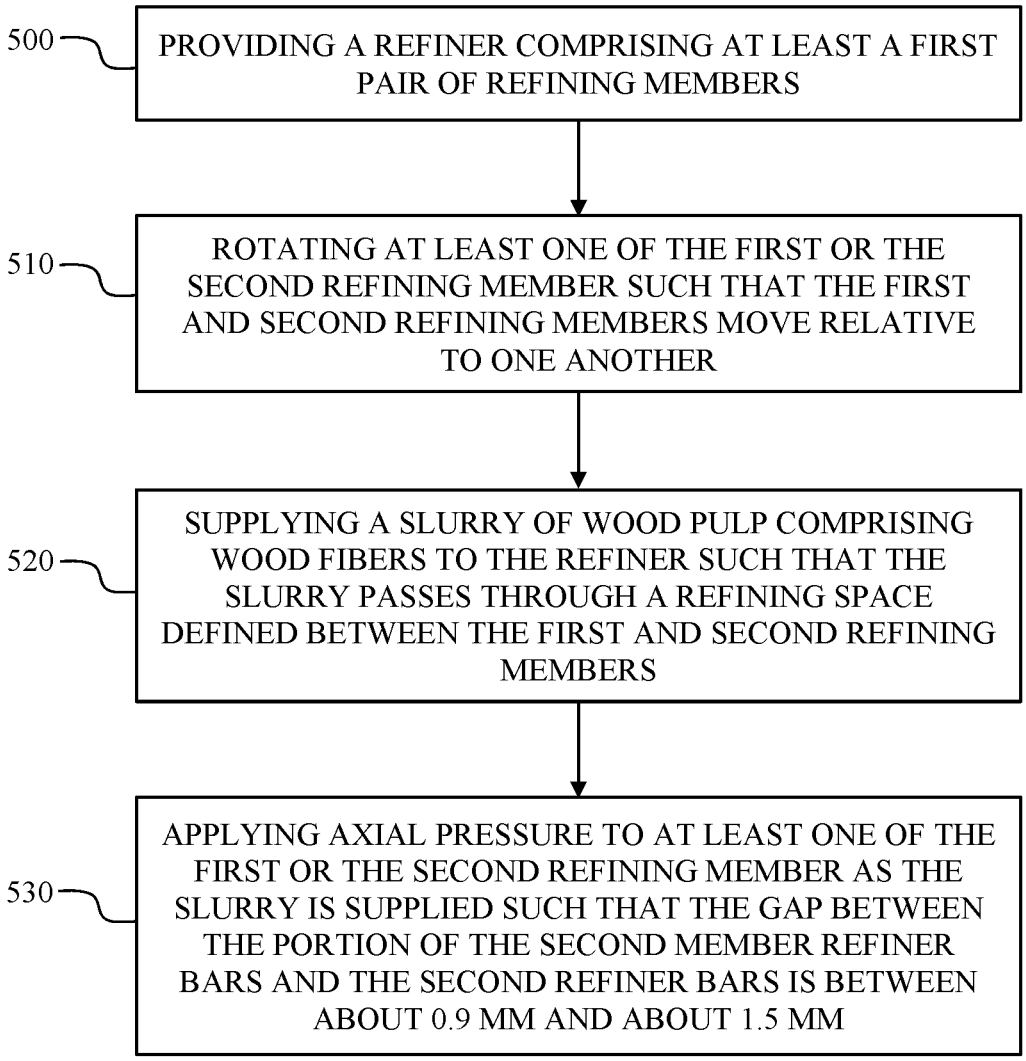
FIG. 18 is a flowchart illustrating an exemplary method for processing wood fibers.

FIG. 18 is a flowchart illustrating an exemplary method for processing wood fibers. Although reference is made to the components of the refiner 10 in FIG. 1, it is understood that the method is not limited only to this structure. The method may begin at Step 500 with providing a refiner 10 comprising at least a first pair of refining members 20 and 30, 40 and 50. The at least one pair of refining members may comprise a first refining member 20 comprising a first refining body 22 including a first refining surface 24 and a second refining member 30 comprising a second refining body 32 including a second refining surface 34. The first refining surface 24 may comprise first refiner bars 26A separated by first refiner grooves 28A and second refiner bars 26B separated by second refiner grooves 28B, in which the first refiner bars 26A have a first maximum height $H_1$ extending upward from a floor $F_1$ of an adjacent first refiner groove 28A and the second refiner bars 26B having a second maximum height $H_2$ extending upward from a floor $F_2$ of an adjacent second refiner groove 28B. The second refining surface 34 may comprise second member refiner bars 36 separated by second member refiner grooves 38. The first refining member 20 may be spaced from the second refining member 30 to define a refining space 60 therebetween. At least a portion of the second member refiner bars 36 may be positioned so as to be across from the second refiner bars 26B of the first refining member 20 such that a gap $G_2$, $G_3$, $G_4$, $G_5$, $G_6$ between the portion of the second member refiner bars 36 and the second refiner bars 26B is defined.

The method may continue with rotating at least one of the first refining member 20 or the second refining member 30 such that the first and second refining members 20, 30 move relative to one another in Step 510, and supplying a slurry of wood pulp comprising wood fibers to the refiner 10 such that the slurry passes through the refining space 60 in Step 520. At Step 530, axial pressure may be supplied to at least one of the first refining member 20 or the second refining member 30 as the slurry is supplied such that the gap $G_2$, $G_3$, $G_4$, $G_5$, $G_6$ between the portion of the second member refiner bars 36 and the second refiner bars 26B is between about 0.9 mm and about 1.5 mm, in which at least a portion of wood fiber bundles passing through the gap $G_2$, $G_3$, $G_4$, $G_5$, $G_6$ are separated, after which the method may terminate.

While particular embodiments of the present invention have been illustrated and described, it should be understood that various changes and modifications may be made without departing from the spirit and scope of the invention. It is therefore intended to cover in the appended claims all such changes and modifications that are within the scope of this invention.

What is claimed is:

1. A method for processing wood fibers, comprising:

deflaking the wood fibers;

refining the wood fibers, wherein the deflaking and refining occurs within a single refiner having at least a first pair of refining members comprising:

a first refining member having a first refining body including a first refining surface comprising:

first refiner bars separated by first refiner grooves and extending from a first radially inward position to a first radially outward position on the first refining surface, the first refiner bars having a first height extending upward from a floor of an adjacent first refiner groove; and second refiner bars separated by second refiner grooves and extending from a second radially inward position to a second radially outward position on the refining surface, the second radially outward position being nearer to an outermost part of the refining body than the first radially outward position, the second refiner bars having a second height extending upward from a floor of an adjacent second refiner groove, wherein the second height is a minimum height of the second refiner bars and is spaced apart from the second radially inward position, the second height being at least about 0.35 mm less than the first height;

a second refining member comprising having a second refining body including a second refining surface comprising second member refiner bars separated by second member refiner grooves, wherein the first refining member is spaced from the second refining member to define a refining space therebetween and at least a portion of the second member refiner bars are positioned so as to be across from the second refiner bars such that a gap between the portion of the second member refiner bars and the second refiner bars is defined;

rotating at least one of the first refining member or the second refining member such that the first and second refining members move relative to one another;

supplying a slurry of wood pulp comprising wood fibers to the refiner such that the slurry passes through the refining space; and applying axial pressure to at least one of the first refining member or the second refining member as the slurry is supplied, wherein at least a portion of wood fiber bundles passing through the gap are separated.

2. The method of claim 1, wherein the second refiner bars have a longitudinal length from about 0.6 cm to about 10 cm.

3. The method of claim 2, wherein the longitudinal length of the second refiner bars is from about 2 cm to about 10 cm.

4. The method of claim 1, wherein the second member refiner bars comprise:

third refiner bars extending from a first radially inward position to a first radially outward position on the second refining surface; and fourth refiner bars extending from a second radially inward position to a second radially outward position on the second refining surface, the second radially outward position being nearer to an outermost part of the second refining body than the first radially outward position, the third refiner bars having a third height extending upward from a floor of an adjacent groove and the fourth refiner bars having a fourth height extending upward from an adjacent groove floor, wherein the fourth height is a minimum height of the fourth refiner bars and is spaced apart from the second radially inward position of the fourth refiner bars, and wherein the fourth height is at least 0.35 mm less than the third height.

5. The method of claim 1, wherein the deflaking of wood fibers occurs within a deflaking zone of the first pair of refining members.

6. The method of claim 1, wherein the refining of wood fibers occurs within a refining zone of the first pair of refining members.

7. The method of claim 1, wherein deflaking the wood fibers is performed at a position located radially outward on the first and second refining surfaces from the refining space.

8. The method of claim 1, wherein the axial pressure is applied such that the gap between the portion of the second member refiner bars and the second refiner bars is between about 0.9 mm and about 1.5 mm.

9. A method of processing wood fibers, comprising:

deflaking the wood fibers; and refining the wood fibers, wherein said deflaking and refining occurs within a single refiner comprising:

a first refining member having a first refining body and a first refining surface; and a second refining member having a second refining body and a second refining surface, wherein deflaking the wood fibers is performed at a position located radially outward on the first and second refining surfaces as compared to the refining step.

* * * * *